US011125423B2

(12) United States Patent
Hatlem et al.

(10) Patent No.: US 11,125,423 B2
(45) Date of Patent: Sep. 21, 2021

(54) POLE CLIMBING DEVICE FOR POSITIONING A LUMINAIRE IN A CONNECTOR ATOP A POLE

(71) Applicant: REMOTECH AS, Nesttun (NO)

(72) Inventors: Stian Hatlem, Hyllestad (NO); Torgeir Jensen, Nesttun (NO); Endre Naess, Straume (NO)

(73) Assignee: REMOTECH AS, Nesttun (NO)

( * ) Notice: Subject to any disclaimer, the term of this patent is extended or adjusted under 35 U.S.C. 154(b) by 0 days.

(21) Appl. No.: 16/772,754

(22) PCT Filed: Dec. 13, 2018

(86) PCT No.: PCT/EP2018/084800

§ 371 (c)(1),
(2) Date: Jun. 12, 2020

(87) PCT Pub. No.: WO2019/115710

PCT Pub. Date: Jun. 20, 2019

(65) Prior Publication Data

US 2020/0332989 A1 Oct. 22, 2020

(30) Foreign Application Priority Data

Dec. 14, 2017 (GB) ..... 1720874

(51) Int. Cl.
*F21V 21/36* (2006.01)
*B66F 11/00* (2006.01)
(Continued)

(52) U.S. Cl.
CPC ..... *F21V 21/116* (2013.01); *F21S 8/086* (2013.01); *F21V 21/36* (2013.01);
(Continued)

(58) Field of Classification Search
CPC ..... F21V 21/02; F21V 21/116; F21V 21/36; F21S 8/085; F21S 8/086; F21W 31/103; B66F 11/00
See application file for complete search history.

(56) References Cited

U.S. PATENT DOCUMENTS 742,447 A * 10/1903 Kinder ..... A63B 27/00 182/133
2,174,525 A * 10/1939 Padernal ..... A63B 27/00 182/133
(Continued)

FOREIGN PATENT DOCUMENTS

CN 107091435 A 8/2017
CN 107120588 A 9/2017
(Continued)

OTHER PUBLICATIONS

International Search Report and Written Opinion of the International Searching Authority issued in PCT/EP2018/084800, dated Apr. 2, 2019; ISA/EP.
(Continued)

*Primary Examiner* — Ismael Negron
(74) *Attorney, Agent, or Firm* — Harness, Dickey & Pierce, P.L.C.

(57) ABSTRACT

A pole climbing device that includes a gripping mechanism for gripping a pole, a drive mechanism for moving the pole climbing device along the pole, and a connector for connecting the pole climbing device to a luminaire support. The pole climbing device might be configured to be remotely controlled by a user to carry a luminaire up the pole to be coupled to a connector.

6 Claims, 20 Drawing Sheets

(51) Int. Cl.

| | |
|---|---|
| ***F21V 21/116*** | (2006.01) |
| ***F21S 8/08*** | (2006.01) |
| ***F21V 23/04*** | (2006.01) |
| ***F21V 23/06*** | (2006.01) |
| *F21W 131/103* | (2006.01) |

(52) U.S. Cl.
CPC ..... *F21V 23/0435* (2013.01); *F21V 23/06* (2013.01); *F21W 2131/103* (2013.01)

(56) References Cited

U.S. PATENT DOCUMENTS

| | | | | |
|---|---|---|---|---|
| 3,520,383 | A * | 7/1970 | Loock | E04G 3/24 182/133 |
| 3,678,265 | A * | 7/1972 | Porter | F21S 8/086 362/355 |
| 3,805,054 | A | 4/1974 | Wolf | |
| 4,025,782 | A * | 5/1977 | Kaeser | F21V 21/38 362/403 |
| 4,878,160 | A * | 10/1989 | Reneau | E04H 12/003 362/269 |
| 6,619,432 | B1 * | 9/2003 | Yasui | B65H 51/14 182/133 |
| 6,665,968 | B2 * | 12/2003 | Jen | G08B 13/19619 248/125.2 |
| 8,403,302 | B2 * | 3/2013 | Erel | B66C 23/027 254/273 |
| 9,581,304 | B2 * | 2/2017 | Carlen | F21S 8/086 |
| 9,835,314 | B1 | 12/2017 | Wright | |
| 10,161,581 | B1 * | 12/2018 | Chiu | F16L 37/02 |
| 10,190,752 | B2 * | 1/2019 | Wright | F21S 8/03 |
| 2015/0040363 | A1 | 2/2015 | Carlen | |
| 2015/0070916 | A1 * | 3/2015 | Al-Asfour | F21V 21/36 362/427 |
| 2016/0053952 | A1 | 2/2016 | Kuti et al. | |

FOREIGN PATENT DOCUMENTS

| | | | |
|---|---|---|---|
| CN | 206817327 | U | 12/2017 |
| FR | 2824624 | A1 | 11/2002 |
| JP | 2005071691 | A | 3/2005 |
| WO | WO-2005059856 | A1 | 6/2005 |
| WO | WO-2008018112 | A1 | 2/2008 |

OTHER PUBLICATIONS

Combined Search and Examinaiton Report issued in GB1720874.5, dated Feb. 14, 2018.

European Examination Report regarding Application No. 18 826 547.4-1015 dated Aug. 11, 2021.

* cited by examiner

POLE CLIMBING DEVICE FOR POSITIONING A LUMINAIRE IN A CONNECTOR ATOP A POLE

CROSS REFERENCE TO RELATED APPLICATIONS

This application is a U.S. National Phase Application under 35 U.S.C. 371 of International Application No. PCT/EP2018/084800 filed on Dec. 13, 2018, which claims the benefit of priority from Great Britain Patent Application No. 1720874.5 filed on Dec. 14, 2017. The entire disclosures of all of the above applications are incorporated herein by reference.

FIELD

The field of the invention is the attachment and detachment of luminaires to light poles. Embodiments provide a releasable attachment between a luminaire and a light pole that can be operated by a pole climbing device. The luminaire can therefore be installed in position and taken down from an installed position by a pole climbing device that can climb the light pole.

BACKGROUND

Good road lighting improves both the safety and the comfort of the road users. Roads are illuminated by light pole systems, which may alternatively be referred to as any of: street lights, lampposts, street lamps, light standards, lamp standards and light poles. A light pole system comprises at least one luminaire, i.e. light, for illuminating the ground its vicinity.

The luminaire of a light pole system needs be maintained. The maintenance typically requires at least replacing the luminaire and washing its reflector. In addition to the maintenance of luminaires, halogen luminaires are being replaced by LED luminaires. For both the maintenance and replacement of the luminaire of a light pole system, it is necessary for a human operator to directly access the luminaire at the point of attachment of the luminaire to the pole so that the luminaire can be removed from its attachment to the pole. This requires a vehicle with an raisable work platform. To access a luminaire, one operator is required to operate the platform from the vehicle and another operator is required in the platform. The operator in the platform is raised up to the position of the luminaire on the pole. The light pole system will typically be next to a road and, in order for the vehicle with the raisable work platform to get into an appropriate position for the luminaire to be accessed, it may also be necessary for a section of the road to be closed.

Known techniques for accessing luminaires on poles are time consuming and costly.

SUMMARY OF INVENTION

According to a first aspect of the invention, there is provided a light pole connector for use in a light pole system, the light pole connector comprising: a first attachment part for attaching the light pole connector to a pole of a light pole system; and a second attachment part for attaching a luminaire support to the light pole connector; wherein: the first attachment part is arranged to receive electrical power from the pole; the second attachment part comprises a connector for providing the electrical power received by the first attachment part to the luminaire support; and the attachment between the light pole connector and the luminaire support is a releasable attachment.

Preferably, the second attachment part is arranged such that, when the light pole connector is attached to the pole, connecting the luminaire support to the light pole connector comprises moving the luminaire support along an axis that is parallel to the longitudinal axis of the pole.

Preferably, the attachment between the light pole connector and the luminaire support comprises a plug and socket attachment.

Preferably, the light pole connector further comprises a locking mechanism; wherein the light pole connector and luminaire support are attached to each other and/or detached from each other by operation of the locking mechanism.

Preferably, the locking mechanism comprises a moveable part; the moveable part is comprised by the luminaire support; and the second attachment part of the light pole connector comprises a receiver of the moveable part.

Preferably, the moveable part is rotatable and the moveable part is arranged such that rotation in a first direction attaches the light pole connector and the luminaire support and rotation in a second direction releases the attachment of the light pole connector and the luminaire support; and/or the moveable part is arranged to move linearly between a first position and a second position such that when the moveable part is in the first position the moveable part attaches the light pole connector and the luminaire support and when the moveable part is in the second position the moveable part does not attach the light pole connector and the luminaire support.

Preferably, at least part of the moveable part is arranged to move along an axis parallel to the longitudinal axis of the pole in the processes of the light pole connector and the luminaire support attaching to each other and detaching from each other.

Preferably, the light pole connector is attached to an end of the pole.

Preferably, the first attachment part is arranged to attach to the outside of the pole.

Preferably, when the light pole connector is attached to the pole, the luminaire support is attached to the light pole connector and a luminaire is attached to the luminaire support, a power supply in the pole can supply power to the luminaire via the light pole connector and the luminaire support; and/or a power supply in the pole can supply power to one or more processors and/or communications devices comprised by one or more of the luminaire, the luminaire support and the light pole connector.

Preferably, the luminaire support is attached to a luminaire of the light pole system.

Preferably, the light pole connector further comprises: a processor configured to control and/or perform diagnostic tests on a luminaire attached to the luminaire support; and/or a communications device configured such that a luminaire attached to the luminaire support and/or a computing device can be controlled remotely.

According to a second aspect of the invention, there is provided a luminaire support for use in a light pole system, the luminaire support comprising: a first attachment part for attaching the luminaire support to a light pole connector of a light pole system; and a second attachment part for attaching the luminaire support to a luminaire of the light pole system; wherein: the first attachment part comprises an electrical connector to a power supply in the light pole connector; and the attachment between the luminaire support and the light pole connector is a releasable attachment.

Preferably, the light pole connector is a light pole connector according to the first aspect.

Preferably, the luminaire support further comprises a locking mechanism; wherein the light pole connector and luminaire support are attached to each other and/or detached from each other by operation of the locking mechanism.

Preferably, the luminaire support further comprises a third attachment part for connecting the luminaire support to a device for actuating the attachment and/or detachment of the luminaire support and light pole connector.

Preferably, the locking mechanism comprises a moveable part; and the moveable part is comprised by the luminaire support.

Preferably, the moveable part is rotatable and the moveable part is arranged such that rotation in a first direction attaches the light pole connector and the luminaire support and rotation in a second direction releases the attachment of the light pole connector and the luminaire support; and/or the moveable part is arranged to move linearly between a first position and a second position such that when the moveable part is in the first position the moveable part attaches the light pole connector and the luminaire support and when the moveable part is in the second position the moveable part does not attach the light pole connector and the luminaire support.

Preferably, the third attachment part comprises the moveable part; and the moveable part is moveable by a device for actuating the attachment and/or detachment of the luminaire support and light pole connector.

Preferably, the locking mechanism is operated by the movement, at least in part along an axis parallel to the longitudinal axis of the pole, of part of an arm into the luminaire support.

Preferably, the attachment between the light pole connector and the luminaire support comprises a plug and socket attachment.

Preferably, the first attachment part of the luminaire support is arranged such that, when the light pole connector is attached to a pole, connecting the luminaire support to the light pole connector comprises moving the luminaire support along an axis that is parallel to the longitudinal axis of the pole.

Preferably, the luminaire support further comprises: a processor configured to control and/or perform diagnostic tests on the luminaire attached to the luminaire support; and/or a communications device configured such that the luminaire and/or a computing device can be controlled remotely.

Preferably, the first attachment part of the luminaire support is elongate; and the third attachment part is elongate and arranged co-linearly with the first attachment part.

Preferably, the second attachment part is a releasable attachment; and the second attachment part comprises an electrical connection with the luminaire such that, in use, electrical power received by the first attachment part of the luminaire support is provided to the luminaire.

Preferably, the second attachment part is a permanent attachment to a luminaire; and the second attachment part comprises an electrical connection to the luminaire such that, in use, electrical power received by the first attachment part of the luminaire support is provided to the luminaire.

According to a third aspect of the invention, there is provided a pole climbing device for climbing and descending the pole of a light pole system, the pole climbing device comprising: a gripping mechanism for gripping a pole of a light pole system; a drive mechanism for moving the pole climbing device along the pole; and a connector for connecting the pole climbing device to a luminaire support.

Preferably, the connector for connecting the pole climbing device to the luminaire support is comprised by an arm of the pole climbing device.

Preferably, in use, a moveable part that is moveable by the pole climbing device causes attachment or detachment of the luminaire support and a light pole connector.

Preferably, the moveable part is arranged so that movement of at least part of the moveable part along an axis that is parallel and/or orthogonal to the longitudinal axis of the pole causes attachment and/or detachment of the luminaire support and a light pole connector.

Preferably, the pole climbing device further comprises a communication device so that the operation of the pole climbing device is controllable remotely.

Preferably, the pole climbing device further comprises a bracket arranged at an end of the pole climbing device such that, when the pole climbing device descends a vertical pole, the bracket is the first part of the pole climbing device to contact the ground at the base of the pole.

Preferably, the pole climbing device is arranged so that it is stackable with one or more further pole climbing devices according to the third aspect.

Preferably, the pole climbing device comprises an elongate arm; and in use on a pole, the longitudinal axis of the arm of the pole climbing device is parallel to the longitudinal axis of the pole.

Preferably, the gripping mechanism for gripping a pole of a light pole system is adaptable so that it can grip poles with a diameter of up to 1000 mm and preferably diameters in the range 60 mm to 300 mm.

Preferably, the pole climbing device further comprises on ore more wheels for moving the pole climbing device along a pole.

Preferably, for at least one of the wheels: the wheel comprises a central part and first and second wings; the first and second wings are attached to opposite ends of the central part; and when the wheel is pressed against a pole, the shapes of the wings of the wheel are arranged to deform more than the shape of the central part of the wheel.

Preferably, one or more of the wheels is arranged so that it can be tilted such that, in use, tilting said one or more of the wheels rotates the pole climbing device around the pole.

Preferably, the pole climbing device further comprises a mechanism for moving the arm of the pole climbing device around the axis of a pole, when the gripping mechanism is gripping the pole, with the connector moving relative to a main body of the pole climbing device.

According to a fourth aspect of the invention, there is provided a device for actuating the attachment and/or detachment of a luminaire support and a light pole connector; wherein, in use, the device comprises an elongate arm with a connector for connecting the device to a luminaire support according to the second aspect; and an actuator for actuating the attachment and/or detachment of the luminaire support and a light pole connector according to the first aspect.

According to a fifth aspect of the invention, there is provided a light pole system comprising: a pole; a light pole connector according to the first aspect; a luminaire support according to the second aspect; and a luminaire; wherein: the light pole connector is attached to the pole; the luminaire support is attached to the light pole connector; and the luminaire is attached to the luminaire support.

According to a sixth aspect of the invention, there is provided a system comprising the light pole system according to the fifth aspect and a pole climbing device according to the third aspect and/or a device according to the fourth aspect.

According to a seventh aspect of the invention, there is provided a method of detaching a luminaire from a pole in a light pole system, wherein the light pole system comprises a pole, a light pole connector attached to the pole, a luminaire support attached to the light pole connector and a luminaire attached to the luminaire support, the method comprising: connecting a pole climbing device to the pole; operating the pole climbing device so that it moves along the pole and connects to the luminaire support; operating the pole climbing device so that it detaches the luminaire support from its attachment to the light pole connector; and operating the pole climbing device so that the pole climbing device and luminaire support move back along the pole.

According to a eighth aspect of the invention, there is provided a method of attaching a luminaire to a pole of a light pole system, wherein the light pole system comprises a pole and a light pole connector attached to the pole, the method comprising: connecting a pole climbing device to the pole; connecting a luminaire support to the pole climbing device, wherein a luminaire is attached to the luminaire support; operating the pole climbing device so that it moves along the pole and connects the luminaire support to the light pole connector; operating the pole climbing device so that it attaches the luminaire support to the light pole connector.

Preferably, in the method of the seventh and eighth aspects, the light pole connector is according to the first aspect; the luminaire support is according to the second aspect; and the pole climbing device is according to the third aspect.

LIST OF FIGURES

DESCRIPTION

Embodiments of the invention improve known techniques for accessing luminaires on poles. Embodiments provide a releasable attachment between a luminaire and a pole. The releasable attachment can be operated by a pole climbing device. The pole climbing device is able to climb a pole, attach a luminaire to a pole, detach a luminaire from a pole and descend a pole. The luminaire can therefore be taken down from its position on a pole by the pole climbing device, serviced by an operator on the ground and then reinstalled in the position on the pole by the pole climbing device. Since it is not necessary for an operator to be elevated to the position of the luminaire, the maintenance and replacement of luminaires of poles is advantageously improved.

Embodiments are described in more detail below.

Figure 1:
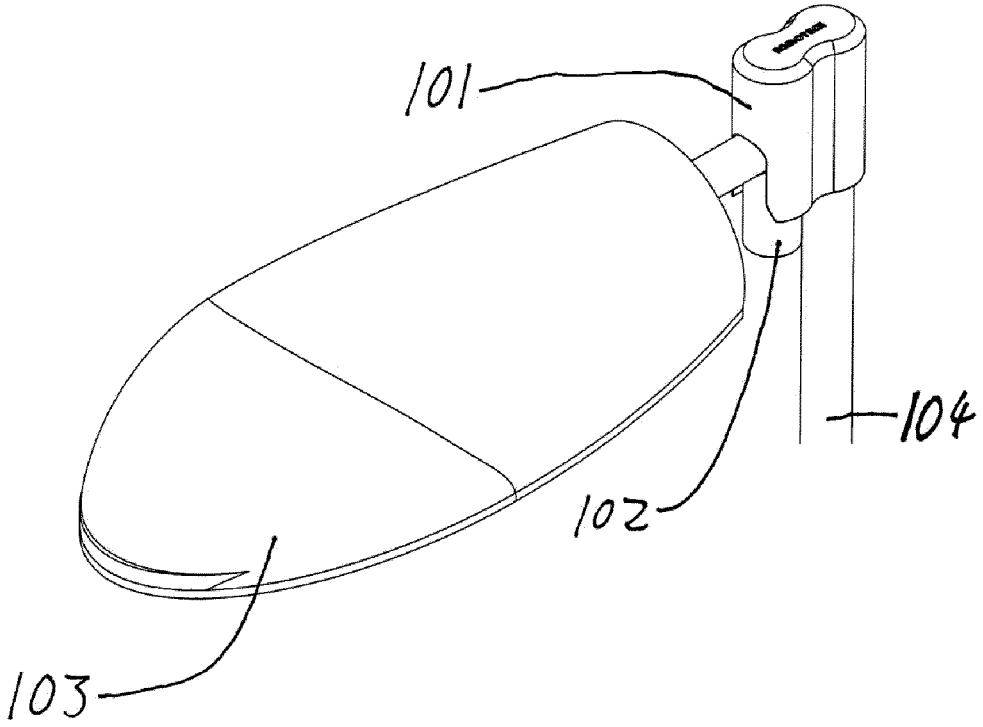
FIG. 1 shows part of a light pole system according to an embodiment.

FIG. 1 shows part of a light pole system according to an embodiment. The light pole system comprises a pole 104, a light pole connector 101, a luminaire support 102 and a luminaire 103.

The pole 104 may be any of a number of known poles that are used in known light pole systems.

The luminaire 103 may be any of a number of known luminaires that are used in known light pole systems. The luminaire 103 may, for example, be a halogen light or an LED light.

Embodiments provide a light pole connector 101 and luminaire support 102 for attaching the luminaire 103 to the pole 104.

FIG. 1 shows the arrangement of the components of the light pole system when the system is operational, i.e the luminaire 103 can be illuminated. The light pole connector 101 is attached to the pole 104, the luminaire support 102 attached to the light pole connector 101 and the luminaire 103 is attached to the luminaire support 102. The pole 104 comprises an electrical power supply and, in use, electrical power is provided from the pole 104 to the luminaire 103 via the light pole connector 101 and luminaire support 102.

Figure 2:
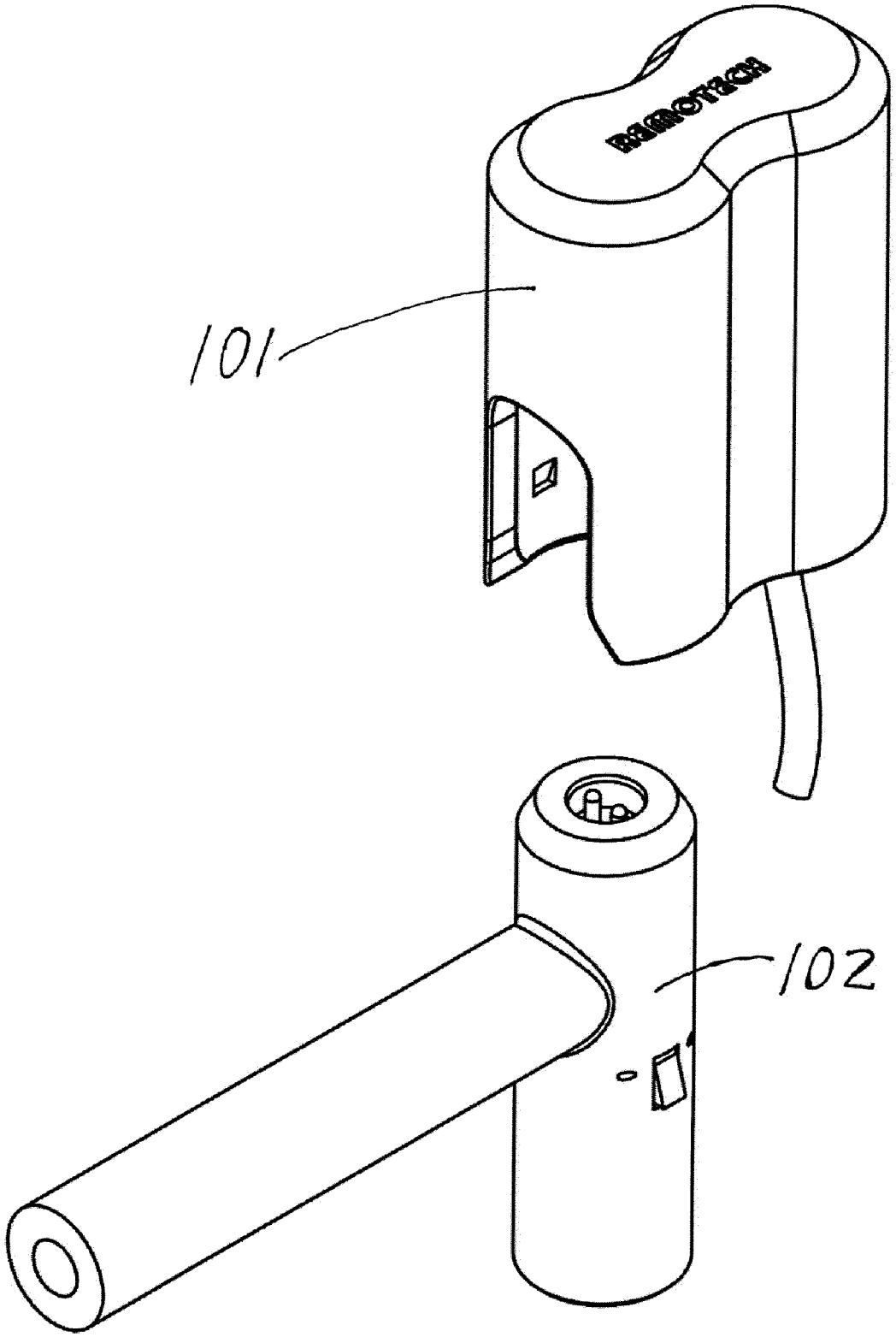
FIG. 2 shows a light pole connector and the luminaire support according to an embodiment.

FIG. 2 shows the light pole connector 101 and the luminaire support 102 when they a detached from each other. The pole 104 and luminaire 103 are not shown in FIG. 2.

The light pole connector 101 comprises a first attachment part for physically attaching the light pole connector 101 to the pole 104. The attachment is preferably made by an end of the light pole 104 being press fitted into the first attachment part of the light pole connector 101. The end of the pole 104 is therefore within and surrounded by the first attachment part. The attachment may be made effectively permanent by, for example, using adhesive or welding the light pole connector 101 to the pole 104. The attachment between the light pole connector 101 and the pole 104 is preferably effectively a permanent attachment as it is unlikely that the light pole connector 101 will need to be detached from the pole 104 during the operational lifetime of the light pole system. However, the light pole connector 101 may alternatively have a detachable connection to the pole 104. For example, the light pole connector 101 may be connected to the pole 104 by one or more set screws.

In use, the first attachment part of the light pole connector 101 also comprises an electrical connection to an electrical power supply in the pole 104. The electrical power supply may be provided by cables that are run along the inside of the pole 104 according to known techniques. The cables in the pole 104 are preferably terminated with one or more electrical connectors that connect to electrical connectors in the light pole connector 101. A combined mechanical and electrical connection may be provided by, for example, a plug and socket connection. The plug and socket connection may have three pins. The light pole connector may have a removable top cover. By removing the top cover when the light pole connector 101 is attached to the pole 104, it may then be possible to access the electrical cables in the light pole connector 101 and/or pole 104 without the light pole connector 101 being detached from the pole 104.

The light pole connector 101 also comprises a second attachment part for physically attaching the light pole connector 101 to the luminaire support 102. The attachment between the light pole connector 101 and the luminaire support 102 is releasable and the light pole connector 101 and luminaire support 102 can be repeatedly attached to and then detached from each other. The attachment between the light pole connector 101 and the luminaire support 102 is preferably a plug and socket attachment with either the second attachment part of the light pole connector 101 being a plug and an end of the luminaire support 102 being a socket or vice versa. The plug and socket connection may have three pins.

The physical attachment between the second attachment part of the light pole connector 101 and the luminaire support 102 is preferably configured such that, when the light pole connector 101 is attached to the pole 104, the luminaire support 102 is brought into contact with, and moved away from, the light pole connector 101 by moving the luminaire support 102 along an axis that is parallel to the longitudinal axis of the pole 104. This alignment during attachment and detachment facilitates the attachment and detachment of the connection between the light pole connector 101 and luminaire support 102 by a pole climbing device that moves along the pole 104, described in more detail later.

The releasable connection between the second attachment part and the luminaire support 102 may be implemented in a number of ways. A locking mechanism may be provided. The locking mechanism may comprise an interlock between a rotatable connecting part and a receiver of the rotatable connecting part. For example, the luminaire support 102 may comprise a rotatable connecting part and the second attachment part may comprise a receiver for receiving the rotatable connecting part. The rotation of the connecting part in a first direction, e.g. clockwise, causes an interlock to be made between the connecting part and the receiver of the connecting part. The light pole connector 101 and luminaire support 102 are therefore held attached to each other by the interlock. The light pole connector 101 and luminaire support 102 can be detached from each other by rotating the connecting part in the opposite direction of rotation, e.g. anticlockwise, so as to release the interlock. Alternatively, the locking mechanism may comprise a slidable part that can be moved out of the luminaire support 102 into the light pole connector 101 to prevent the luminaire support 102 moving relative to the light pole connector 101 and can be moved back into the luminaire support 102 to allow the luminaire support 102 to move relative to the light pole connector 101.

The second attachment part also comprises one or more electrical connectors for providing an electrical connection between the second attachment part of the light pole connector 101 and corresponding one or more electrical connectors in the luminaire support 102. The electrical connection allows electrical power to be provided from a power supply in the pole 104 to the luminaire support 102 via the light pole connector 101.

As shown in FIGS. 1 and 2, the luminaire support 102 comprises an elongate part for connecting to the light pole connector 101, an elongate part for connecting to the luminaire 103 and an elongate part for connecting to the pole climbing device. The elongate parts may be arranged as shown, so that the luminaire support 102 has a T shape, but embodiments include other configurations. For example, it is not necessary for the elongate part for connecting to the luminaire 103 to be orthogonal to the other elongate parts. The elongate part for connecting to the light pole connector 101 is preferably co-linear with the elongate part for connecting to the pole climbing device as this aids the operation of the pole climbing device. The luminaire support 102 therefore has three end points. A first end point is for a releasable physical and electrical connection to the light pole connector 101 as described above. A second end point of the luminaire support 102 is for connecting to a luminaire 103. A third end point of the luminaire support 102 is for connecting to a pole climbing device.

The first end point is as described above. The luminaire support 102 preferably comprises a connecting part that can form an interlock with a receiver in the light pole connector 101.

The attachment and detachment of the luminaire support 102 and light pole connector 101 may be made by rotating the connecting part.

The luminaire 103 may be any known luminaire 103 and the physical attachment of the second end point of the luminaire support 102 and the luminaire 103 may be made using a known attachment to a luminaire 103. The attachment may be either releasable or effectively permanent. The luminaire 103 may alternatively be similar to known luminaires but differ by being manufactured so that it is made integrally with the luminaire support 102. The luminaire support 102 is arranged so that, in use, there is an electrical connection between the luminaire 103 and the light pole connector 101. Electrical power is provided to the luminaire 103 from a power supply in the pole 104 via the light pole connector 101 and luminaire support 102.

The third end point of the luminaire support 102 is arranged to engage with a pole climbing device. The pole climbing device is able to ascend and descend the pole 104 both on its own and carrying the luminaire support 102 and luminaire 103. Preferably, the third end point of the luminaire support 102 comprises a receiver of an arm 302 of the pole climbing device so that the luminaire 103 and pole climbing device are held together by the fit of the arm 302 into the receiver of the arm 302. The receiver may be a recess in the third end point of the luminaire support 102. The end part, i.e. bottom, of the receiver of the arm 302 preferably comprises an receiving part of a connecting part, such as a key, on the end of the arm 302 of the pole climbing device. The receiving part may be part of, or mechanically attached to, a rotatable connecting part as described above, the rotation of which attaches, or detaches, the luminaire support 102 and light pole connector 101. The rotation of the arm 302 of the pole climbing device may cause rotation of the connecting part. Additionally, or alternatively, the arm of the pole climbing device may comprise an actuator for moving a slidable part in the luminaire support 102. The luminaire support 102, with or without a luminaire 103 attached to it, can therefore be attached or detached from the light pole connector 101 by the pole climbing device.

Figure 3B:
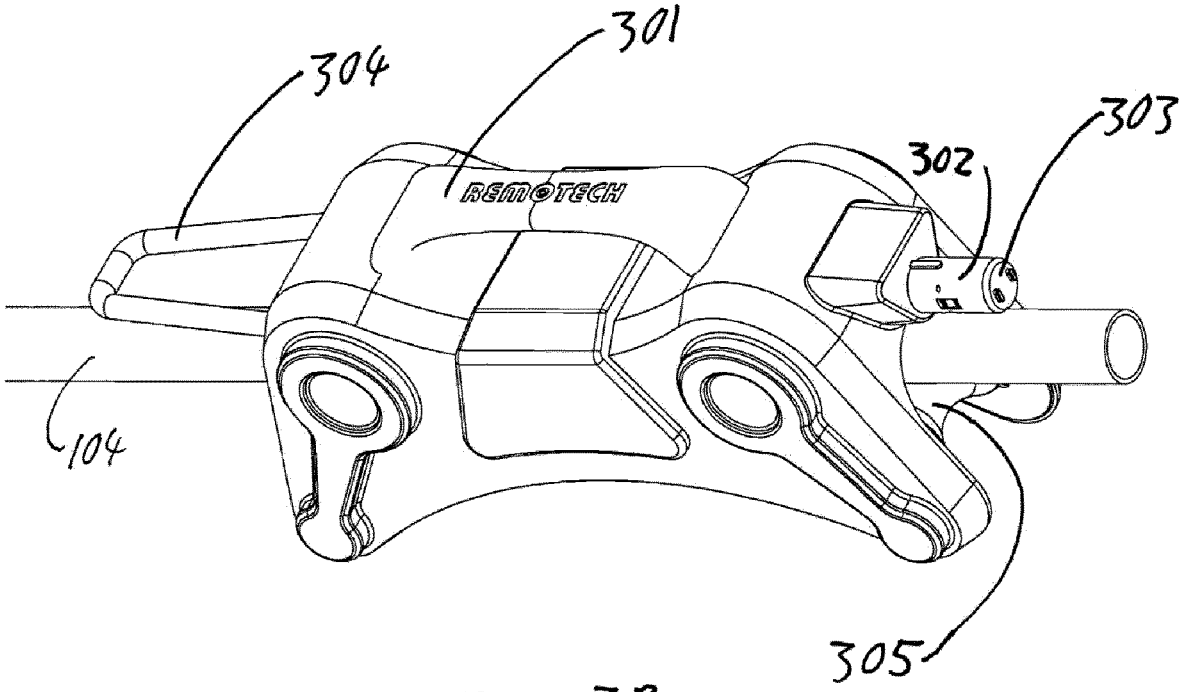
FIGS. 3A, 3B, 3C and 3D show a pole climbing device according to an embodiment.
Figure 3A:
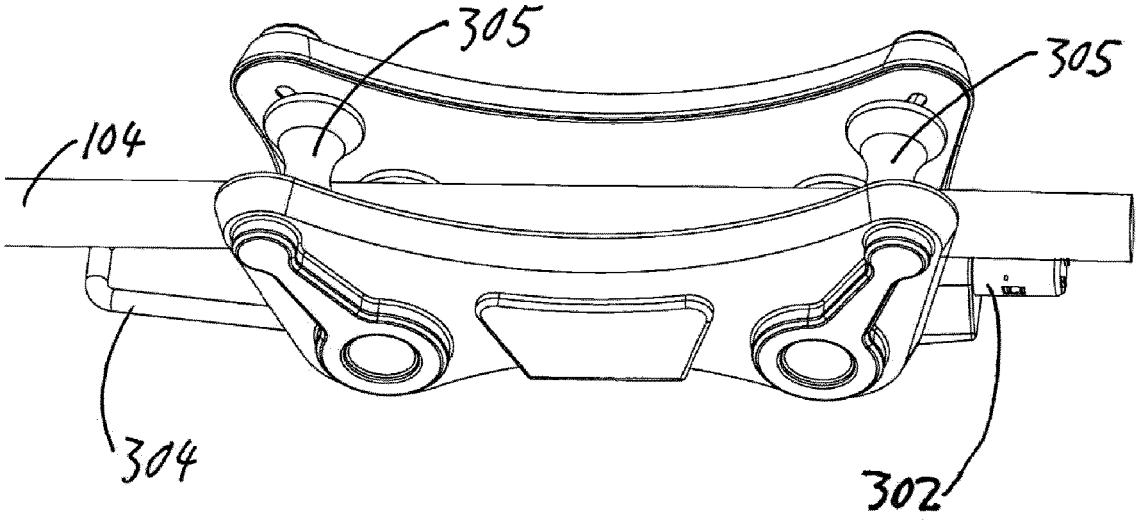
Figure 3C:
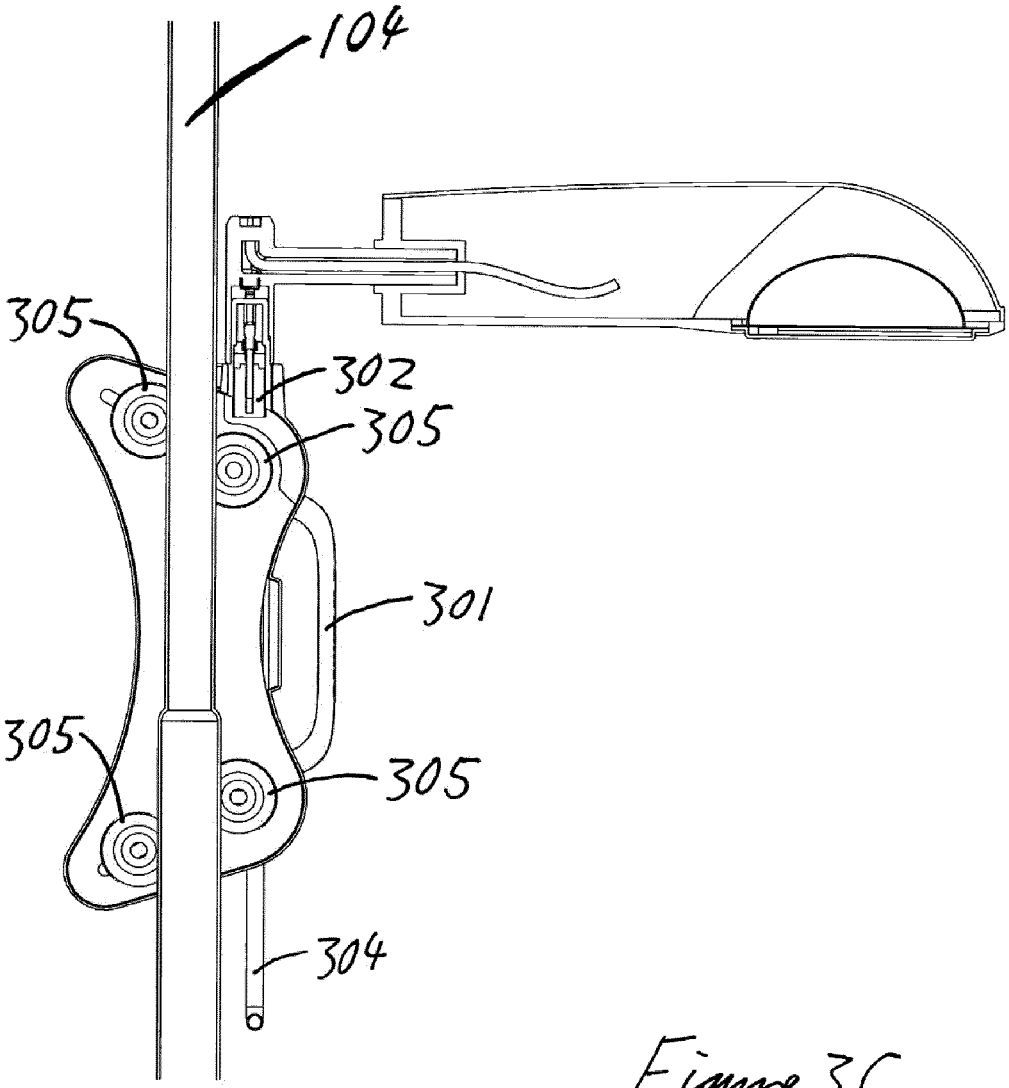
Figure 3D:
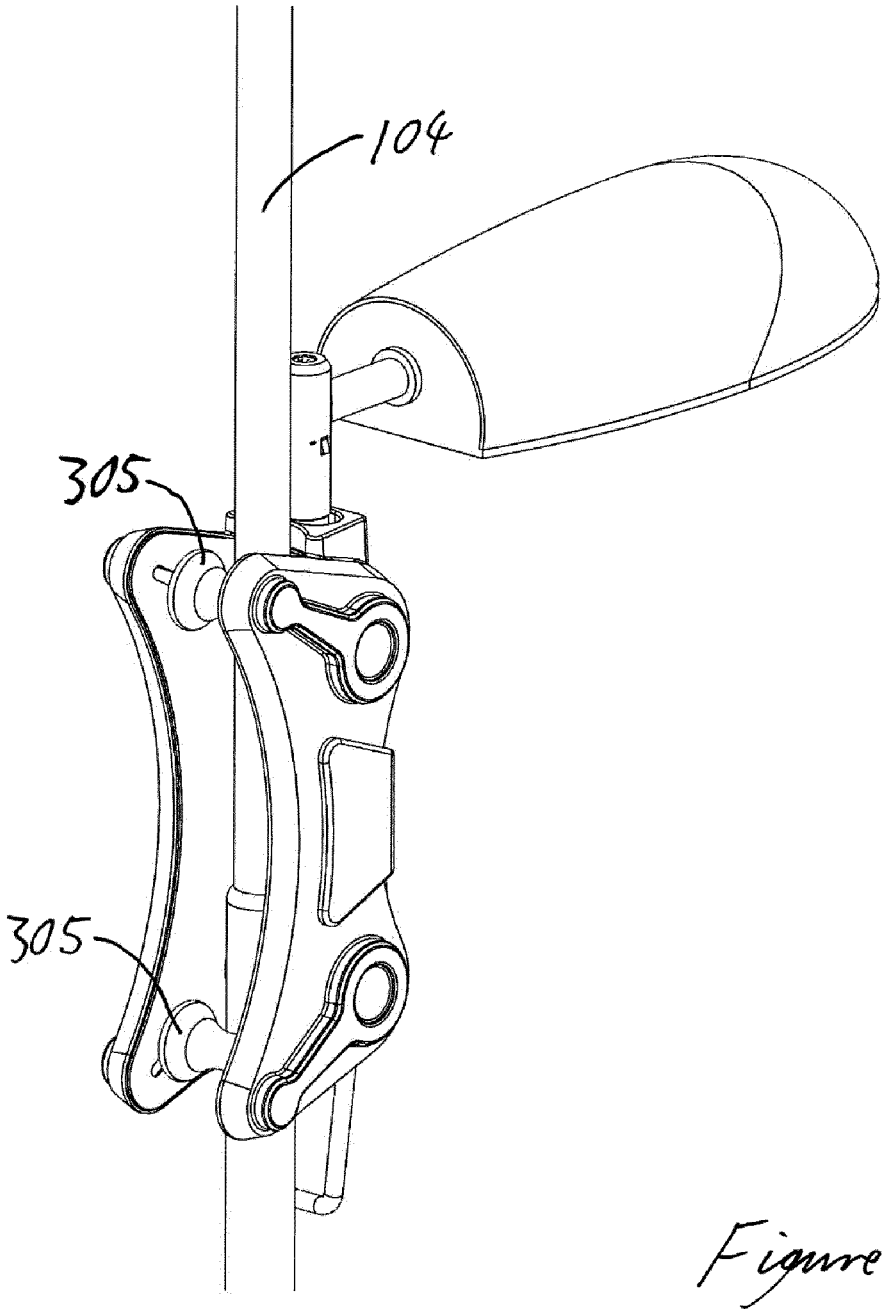

FIGS. 3A, 3B, 3C and 3D show a pole climbing device according to an embodiment. The pole climbing device is shown positioned on and gripping the pole 104 of a light pole system. In FIGS. 3A and 3B, the pole climbing device is not connected to a luminaire support 102. In FIGS. 3C and 3D, the pole climbing device is connected to a luminaire support 102. FIG. 3C shows a cross-section through the pole climbing device so that the wheels in the pole climbing device are shown.

The pole climbing device can be both positioned on and removed from poles 104. The pole climbing device comprises one or more wheels 305 that are arranged to grip the pole 104 in order to hold the pole climbing device to the pole 104. The pole climbing device comprises a motor for driving at least one wheel 305 of the pole climbing device so that the pole climbing device can move along the pole 104. For a vertically orientated pole 104, the pole climbing device vertically ascends or descends the pole 104. A pole 104 may also comprise one or more non-vertical sections and the pole climbing device is also capable of moving along these. The pole climbing device has a main body that comprises the motor, at least one wheel 305 and an arm 302. Preferably, at least one wheel 305 in the main body is driven by the motor.

As shown in FIG. 3C, the pole climbing device also has wheels on the other side of the pole 104 to the main body of the pole climbing device for holding the pole climbing device to the pole 104. These wheels are preferably releasable from the pole climbing device so that the pole climbing device can be easily attached to the pole 104 by removing the wheels, positioning the pole climbing device on the pole 104 and then attaching the wheels so that the pole 104 is encircled by the pole climbing device. The wheels preferably self-regulating, i.e. they change position into order to automatically grip the pole 104. The pole climbing device preferably comprises one or more springs arranged to bias the wheels so that the pole climbing device automatically grips the pole 104. The wheels may be hinged and/or arranged to move linearly. The self-regulating wheels hallow a wide range of pole 104 diameters to be gripped to. As shown in FIGS. 3C and 3D, the diameter of a pole may vary along the length of the pole. Each of the wheels may either be freely rotatable or driven by the motor.

The arm 302 of the pole climbing device is preferably rotatable in both clockwise and anti-clockwise directions. The rotation may be powered by the same motor that drives the wheel that moves the pole climbing device along the pole 104 or the pole climbing device may comprise a separate motor for rotating the arm 302. The arm 302 may additionally, or alternatively, be extendable and retractable so it can move into and out of the pole climbing device's main body. Additionally, or alternatively, the arm 302 of the pole climbing device may comprise an actuator for moving a slidable part in the luminaire support 102.

As described above, the arm 302 of the body is arrange to engage with a receiver of the arm 302 on a luminaire support 102. The end of the arm 302 of the pole climbing device preferably has a connecting part 303, such as a key or tool. The connecting part 303 may engage with a receiving part in the luminaire support 102 so that rotation of the arm 302 causes rotation of a connecting part between the luminaire support 102 and the light pole connector 101. Additionally, or alternatively, the arm 302 of the pole climbing device may comprise an actuator for moving a slidable part in the luminaire support 102.

The main body of the pole climbing device may comprise a battery and a wireless communication device for allowing the pole climbing device to be operated remotely. The pole climbing device may additionally, or alternatively, have a wired power connection and/or be controlled via wired communication with an operator's systems on the ground.

The pole climbing device preferably has a bracket 304 at the opposite end of the main body to the arm 302. The bracket 304 aids the carrying of the pole climbing device and, by being the first point of contact with the ground when the pole climbing device descends a vertical pole 104, the bracket 304 protects the pole climbing device in the event that operator error, or other error, causes the pole climbing device to uncontrollably descend the pole 104 and hit the ground.

The pole climbing device preferably also has a handle 301 in the middle of its main body so that it can be easily carried by an operator.

Figure 4C:
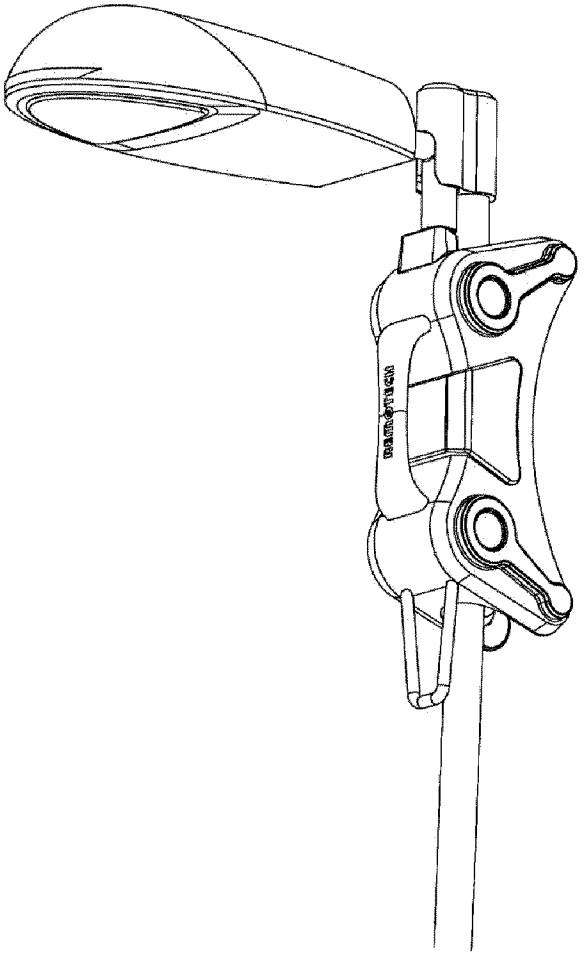
FIGS. 4A, 4B and 4C show the pole climbing device positioned on a pole and also engaged with a luminaire support according to an embodiment.
Figure 4B:
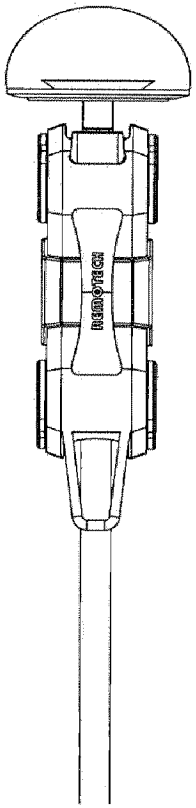
Figure 4A:
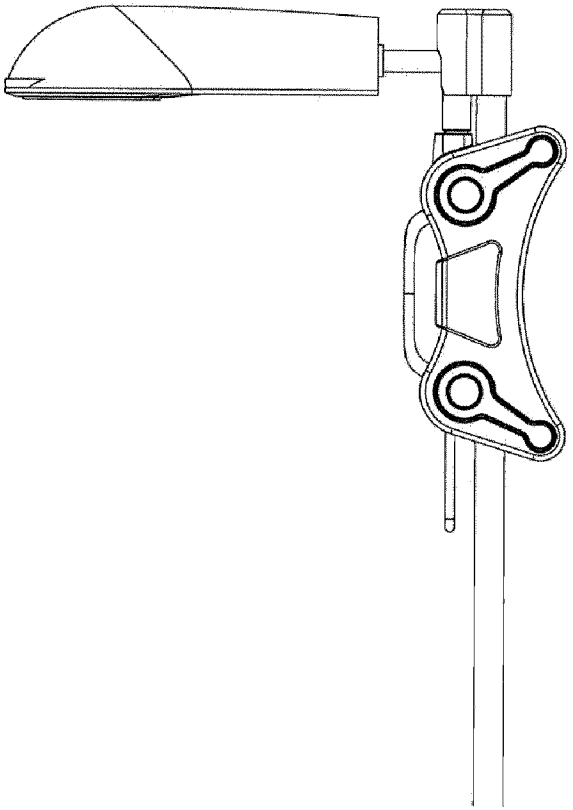

FIGS. 4A, 4B and 4C show the pole climbing device positioned on a pole 104 and also engaged with a luminaire support 102. In the shown position, the pole climbing device may either attach the luminaire support 102 to the light pole connector 101 or detach the luminaire support 102 from the light pole connector 101.

Figure 5A:
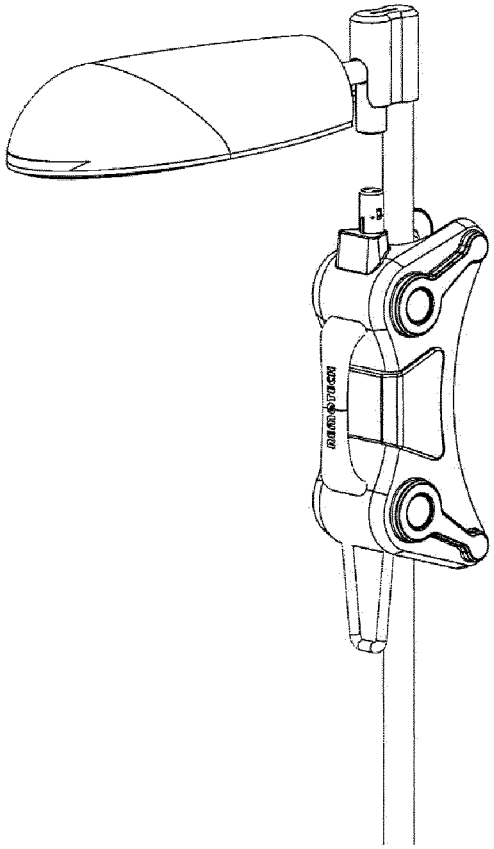
FIGS. 5A and 5B show steps a method of taking a luminaire down from a light pole and installing a luminaire on a light pole according to an embodiment.
Figure 5B:
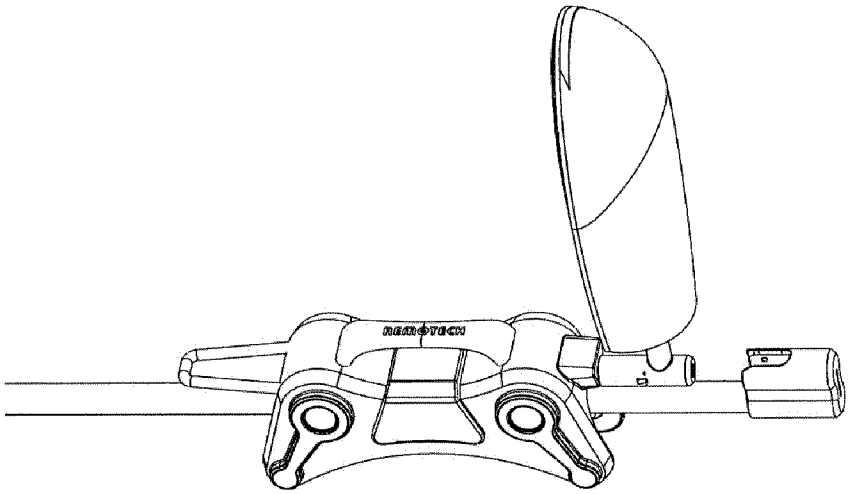

FIGS. 5A and 5B, in addition to FIGS. 4A, 4B and 4C, show relative positions of the pole climbing device and luminaire in a method of taking a luminaire 103 down from a light pole 104 and installing a luminaire 103 on a light pole according to an embodiment.

The method comprises an operator on the ground attaching the pole climbing device to the vertical pole 104 of the light pole system. The operator is able to control the ascent and descent of the pole 104 by the pole climbing device with a remote control. The operator controls the pole climbing device so that the pole climbing device ascends the pole 104, as shown in FIG. 5A, and engages with the luminaire support 102, as shown in FIGS. 4A, 4B and 4C. The operator then controls the pole climbing device so that the luminaire support 102 is released from the light pole connector 101. For example, controlling the pole climbing device arm 302 to rotate anti-clockwise may release the connection between the luminaire support 102 and light pole connector 101. The pole climbing device is then controlled to descend the pole 104. The luminaire support 102 is held by the pole climbing device, as shown in FIG. 5B, and therefore also descends the pole 104. The luminaire 103 is attached to the luminaire support 102 and therefore lowered down the pole 104 with the luminaire support 102. The operator can then remove the luminaire support 102 from the pole climbing device and service or replace the luminaire 103. To return the luminaire 103 to the position at the top of a light pole 104, the luminaire 103 is attached to a luminaire support 102 which is positioned on the arm 302 of the pole climbing device. The operator then controls the pole climbing device to ascend the pole 104 and, when at the top of the pole 104, the pole climbing device attaches the luminaire support 102 to the light pole connector. The luminaire support 102 may be attached to the light pole connector 101 by, for example, the arm 302 of the pole climbing device rotating clockwise.

Advantageously, a luminaire 103 can be taken down from its position on a light pole 104 and then repositioned with the human operator remaining on the ground. No raisable elevation platform or ascent of the pole 104 by the human operator is required and this both reduces costs and increases safety. Only a single operator is required and this reduces costs.

An additional advantage of embodiments is that the requirement on the operator's vehicles are reduced. The operator's vehicle need only have sufficient storage space for a pole climbing device and the equipment required for servicing or replacing the luminaire 103.

The vehicle may therefore be a small van, quad bike, ATV, trolley or motorbike. Embodiments also include there being no vehicle and the operator instead carrying all of the equipment in a backpack. The operator can therefore easily access light pole systems that are difficult for large vehicles to access, such as light pole systems in pedestrian only areas.

Figure 6:
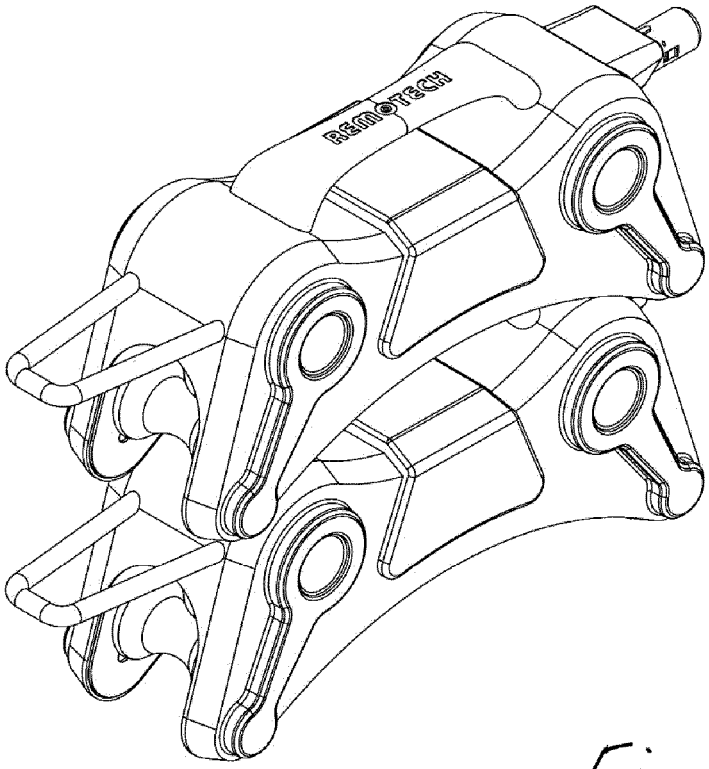
FIG. 6 shows a stack of pole climbing devices according to an embodiment.

As shown in FIG. 6, the pole climbing devices are preferably designed so that they can be stacked on top of each other. A plurality of pole climbing devices can therefore be easily transported together, such as in the back of a van.

Embodiments include a number of modifications and variations of the above-described techniques.

In the embodiments described above, the rotation of a connecting part may attach and detach the luminaire support 102 and light pole connector 101. The connecting part may rotate in response to rotation of the arm 302 of the pole climbing device. In an alternative embodiment, the arm 302 of the pole climbing device does not rotate when attaching and detaching the luminaire support 102 and light pole connector 101. The pole climbing device can both attach and detach the luminaire support 102 and light pole connector 101 by linearly moving the arm of the pole climbing device into the luminaire support 102.

FIGS. 7A to 7F are cross-sections that show alternative designs of arm 302 of the pole climbing device, connecting part 303 of the pole climbing device, luminaire support 102 and light pole connector 101 as well as steps during the detachment of a luminaire support 102 and light pole connector 101, according to an embodiment.

Figure 7A:
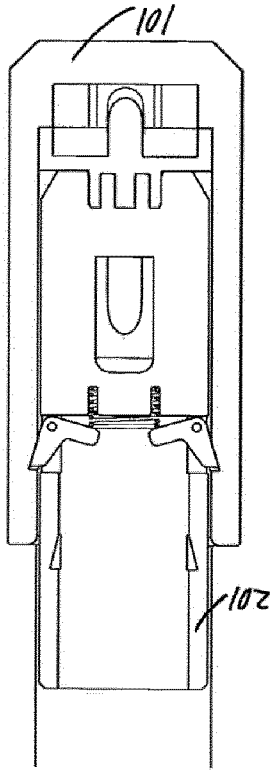
FIGS. 7A, 7B, 7C, 7D, 7E and 7F show steps in the operation of detaching the luminaire support from the light pole connector by a pole climbing device.

FIG. 7A shows the luminaire support 102 attached to the light pole connector 101 by a locking mechanism. The luminaire support 102 is attached to the light pole connector 101 by at least two hinged catches.

Figure 7B:
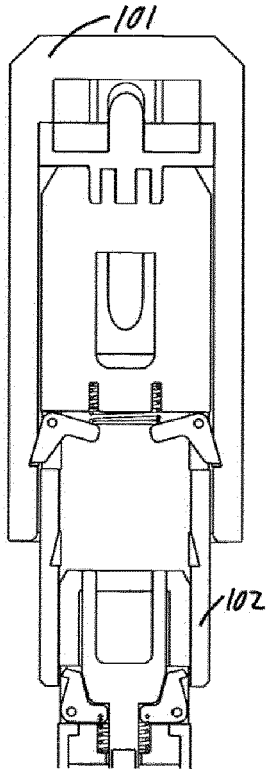

FIG. 7B shows the end of the arm 302 of the pole climbing device entering the luminaire support 102. The movement of the arm 302 is linear, i.e. along an axis that is parallel to the axis of the pole 104.

Figure 7C:
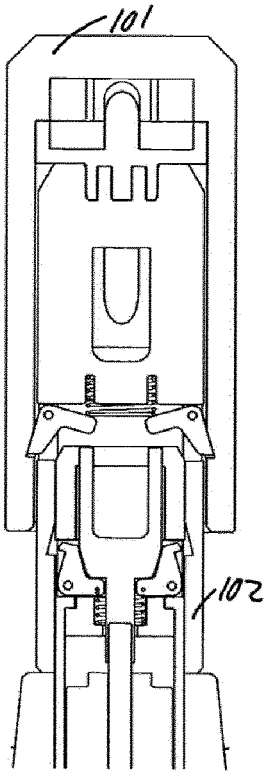

In FIG. 7C, the arm 302 of the pole climbing device is in position for detaching the luminaire support 102 from the light pole connector 101 but the detachment process has not started yet.

Figure 7D:
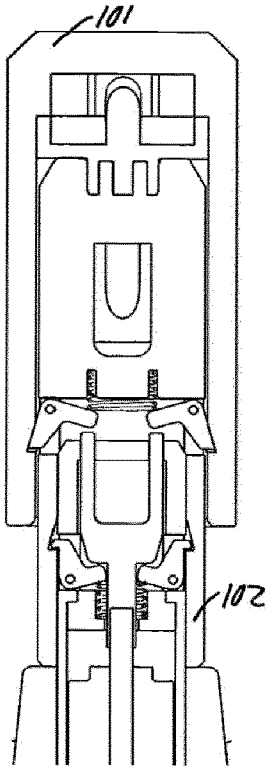

In FIG. 7D, a connecting part 303, which may be an actuator, has moved out of the end of the arm 302 of the pole climbing device. The linear movement, i.e. along an axis parallel to the axis of the pole 104, of the connecting part 303 causes catches to rotate and thereby attach the pole climbing device to the luminaire support 102. In FIG. 7D, the luminaire support 102 is still attached to the light pole connector 101.

Figure 7E:
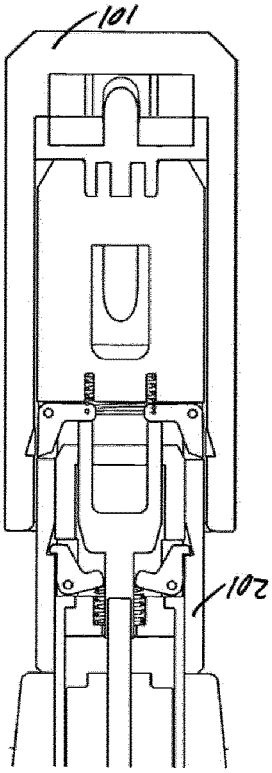

In FIG. 7E, the connecting part 303 has moved linearly further out of the end of the arm 302 and rotated the catches that were attaching the luminaire support 102 to the light pole connector 101. This releases the attachment between the luminaire support 102 to the light pole connector 101.

Figure 7F:
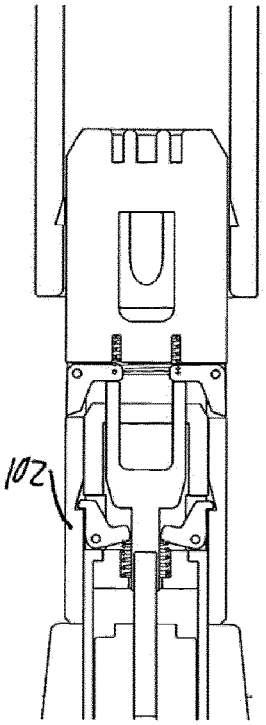

FIG. 7F shows the pole climbing device descending the pole 104 with the luminaire support 102 attached to the pole climbing device and detached from the light pole connector 101.

The processes of the pole climbing device attaching a luminaire support 102 to the light pole connector 101 are similar to the processes for detaching a luminaire support 102 from the light pole connector 101, but performed in substantially the reverse order. Accordingly, in the present embodiment substantially only linear, i.e. parallel to the axis of the pole 104, movement of the arm 302 and/or connecting part 303 of the pole climbing device is required when the luminaire support 102 is both attached to, and detached from, the light pole connector 101.

Figure 8:
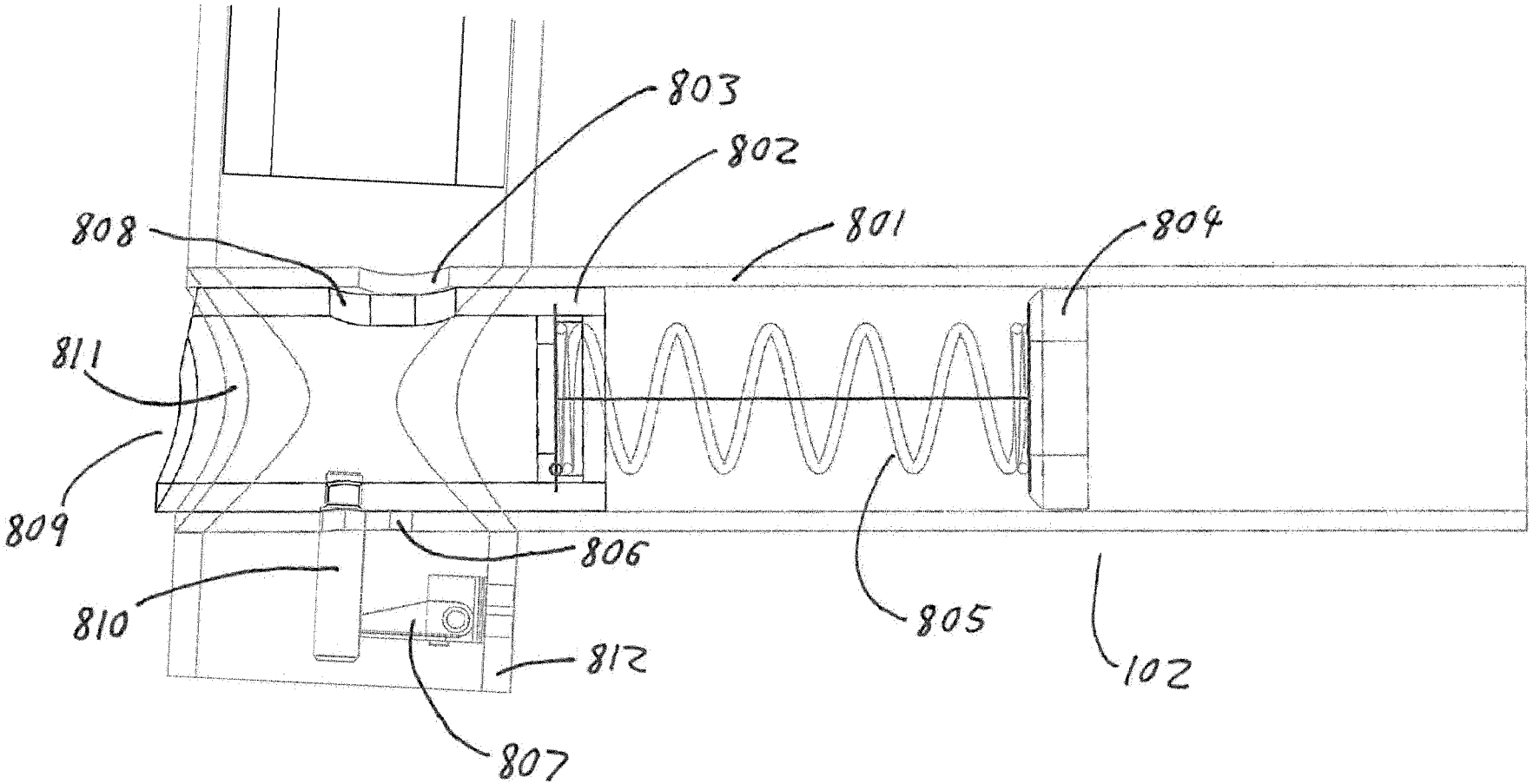
FIG. 8 shows a luminaire support according to an embodiment.
Figure 9A:
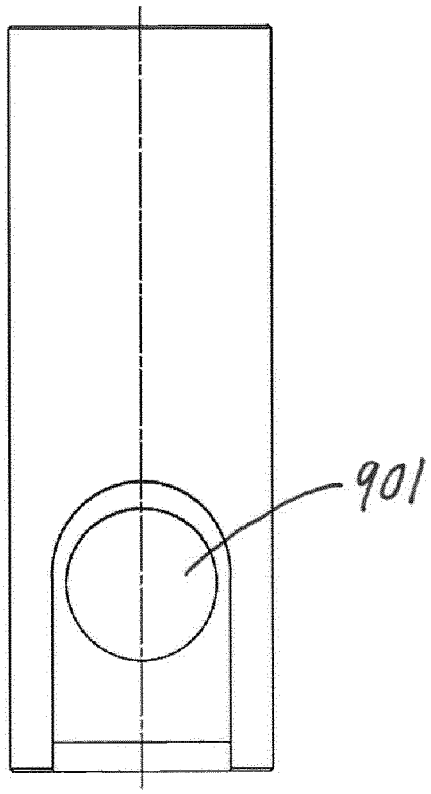
FIGS. 9A and 9B show a light pole connector according to an embodiment.
Figure 9B:
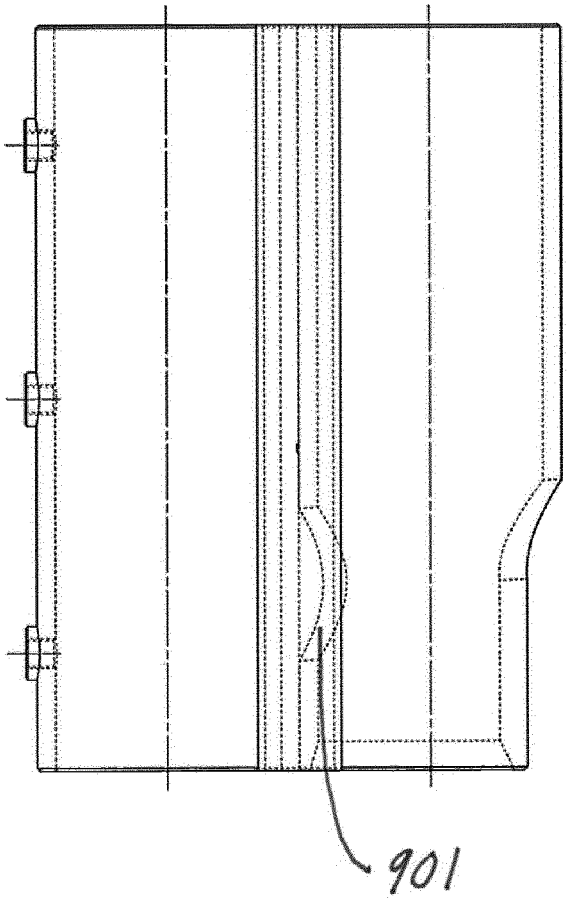
Figure 10:
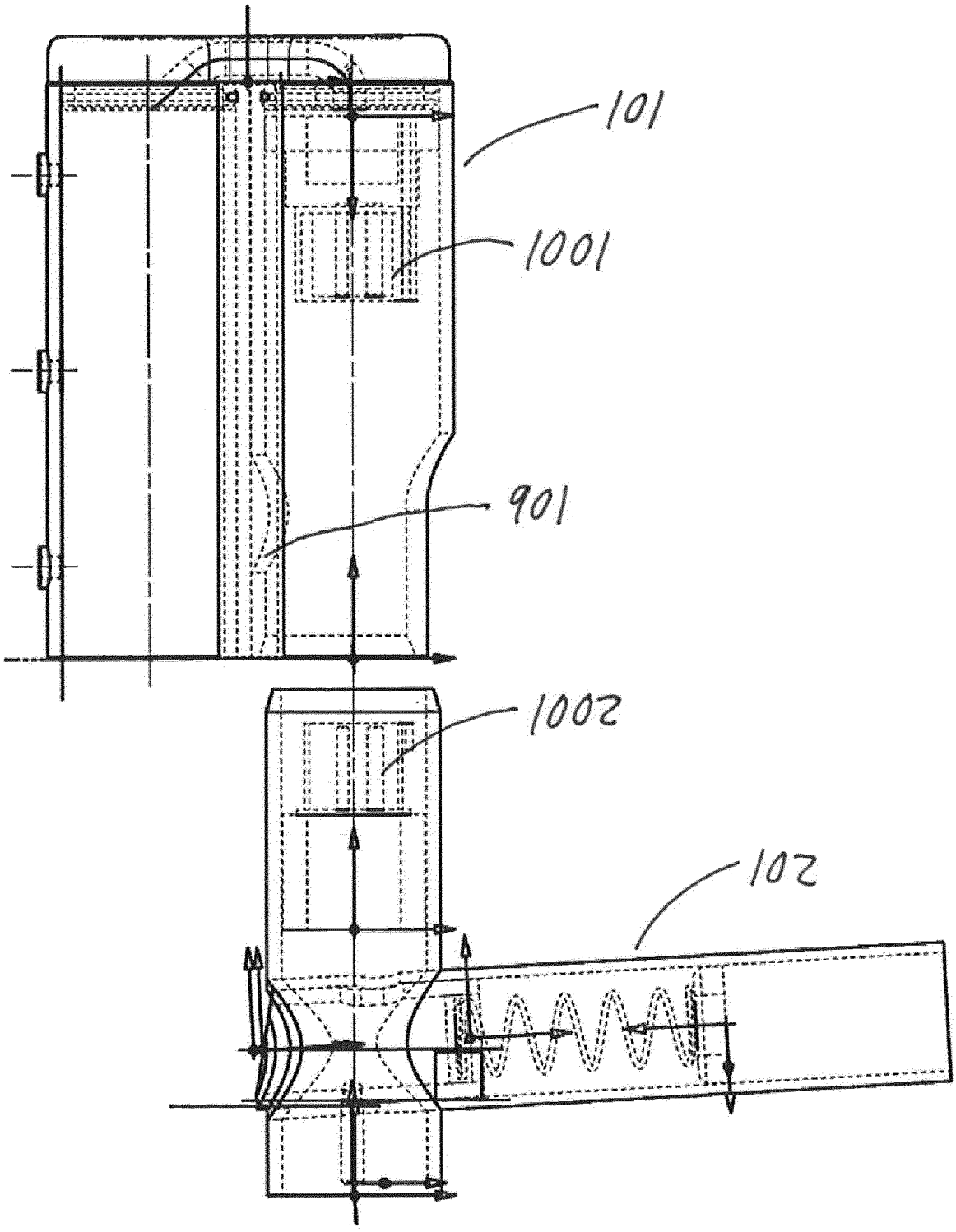
FIG. 10 shows a light pole connector and a luminaire support according to an embodiment.

Another embodiment for attaching and detaching the luminaire support 102 and light pole connector 101 is shown in FIGS. 8 to 10. In the present embodiment, the pole climbing device may attach and detach the luminaire support 102 and light pole connector 101 with substantially only linear movements of the arm of the pole climbing device into the luminaire support 102.

The luminaire support 102 according to the present embodiment is shown in FIGS. 8 and 10. The light pole connector 101 according to the present embodiment is shown in FIGS. 9 and 10.

The luminaire support 102 comprises a slidable part 802. The slidable part 802 may be substantially tubular. The longitudinal axis of the slidable part 802 may be arranged so that it is substantially orthogonal to the longitudinal axis of a first elongate part 812 of the luminaire support 102 for connecting to the pole climbing device. The slidable part 802 may be arranged so that it can be received within at least part of a second elongate part 801 of the luminaire support 102 for connecting to the luminaire 103.

The second elongate part 801 may be substantially tubular. The second elongate part 801 may comprise a fixed part 804 that substantially does not move relative to main body of the second elongate part 801. The fixed part 804 may provide a base for a spring 805 within the second elongate part 801. The spring 805 may be arranged between the fixed part 804 and a first end of the slidable part 802. The first elongate part 812 may comprise an opening 811 through which a second end 809 of the slidable part 802 may move. The spring 805 may be arranged such that it applies a force to the first end of the slidable part 802 that acts to move the second end 809 of the slidable part 802 through the opening and out of the luminaire support 102. The second elongate part 801 may comprise an outer wall that substantially extends through the first elongate part 812. The parts of the outer wall of the second elongate part 801 within the first elongate part 812 may comprise a first opening 803 and a second opening 806.

The slidable part 802 may comprise a rod 810 attached to its outer surface. The longitudinal axis of the rod 810 may be substantially normal, i.e. substantially orthogonal, to the longitudinal axis of the slidable part 802. The rod 810 may extend through the second opening 806. As shown in FIG. 8, the extent that the slidable part 802 may move along the longitudinal axis of the second elongate part 801 may be restricted by at least the action of the rod 810 against the sides of the second opening 806.

The action of the spring 805 biases the slidable part 802 into a first position in which at least part of the second end 809 of the slidable part 802 protrudes out of the outer surface of the luminaire support 102. The slidable part 802 can be moved to a second position in which substantially no part of the second end 809 of the slidable part 802 protrudes out of the outer surface of the luminaire support 102. A way of moving the slidable part 802 from the first position to the second position is to apply a force that moves the slidable part 802 towards the fixed part 804. The applied force should be larger than the force applied by the spring 805. The force may be applied to the rod 810. Alternatively, or additionally, the force may be applied to the second end 809 of the slidable part 802. For example, the end surface of the second end 809 of the slidable part 802 may be inclined, as shown in FIG. 8, such that the contact of the end surface of the second end 809 of the slidable part 802 with the walls of the light pole connector 101 as the luminaire support is moved into the light pole connector 101 results in a force that moves the slidable part 802 towards the fixed part 804.

The slidable part 802 may comprise an opening 808 that is aligned with the first opening 803 so as to form a combined opening through the walls of the second elongate part 801 and the slidable part 802. The opening 808 may be larger/longer than the opening 803. The first opening 803 and opening 808 are arranged so that there is a combined opening through the walls of the second elongate part 801 and the slidable part 802 both when the slidable part 802 is in the first position and when the slidable part 802 is in the second position. There is also an opening through the fixed part 804. The first opening 803 in the second elongate part 801, the opening 808 through the slidable part 802 and the opening through the fixed part 804 provide a path for electrical wires through the luminaire support 102 to a luminaire 103.

The end surface of the arm 302 of the pole climbing device may have an inclined surface so that the end surface is not orthogonal to the longitudinal axis of the arm 302. The inclined end surface of the arm 302 causes the linear movement of the arm 302 into the luminaire support 102 to apply a force on the rod 810 that moves the slidable part 802 from its first position to its second position. Accordingly, the linear insertion of the arm 302 into the luminaire support can release the attachment between the luminaire support 102 and the light pole connector 101.

The second end 809 of the slidable part 802 may be either open or closed. If the second end 809 is closed, it is harder for fluids, such as water and water vapour, to flow the inside the luminaire support 102 and this may help to protect the wires and electrical connections inside the luminaire support 102.

The first elongate part optionally comprises a catch 807. The catch may be a hinged part that is biased, such as by a spring or gravity, to a first position of the catch, as shown in FIG. 8, in which the catch prevents the rod 810 from moving and therefore prevents the slidable part 802 from moving from the first position of the slidable part 802 to the second position of the slidable part 802. The catch 807 may be moved from a first position of the catch to a second position of the catch by rotating about the hinge. When the catch is in its second position, the catch does not prevent the rod 810 from moving and so the slidable part 802 may be moved from the first position of the slidable part 802 to the second position of the slidable part 802. The catch 807 may be moved from a first position of the catch to a second position of the catch by, for example, the end of the arm 302, and/or a connecting part 303, of the pole climbing device.

FIGS. 9A and 9B show a light pole connector 101 of the present embodiment. The light pole connector 101 of the present embodiment comprises an opening 901 in its second attachment part, wherein the second attachment part is the part of the light pole connector 101 that the luminaire support 102 is inserted into. The opening 901 is arranged to receive the second end 809 of the slidable part 802 of the luminaire support 102.

FIG. 10 shows the light pole connector 101 axially aligned with the luminaire support 102. The light pole connector 101 comprises an electrical connector 1001. The luminaire support 102 comprises an electrical connector 1002. Electrical connector 1001 may be a plug and electrical connector 1002 a socket, or vice-versa.

When the luminaire support 102 is moved along its longitudinal axis into the light pole connector 101, the slidable part 802 may be moved from its first position to its second position due to the action of the end surface of the second end 809 of the slidable part 802 against the walls of the light pole connector 101. Alternatively, or additionally, the slidable part 802 may be moved to and/or held in its second position by an action on the rod 810, such as by the pole climbing device.

When the second end 809 of the slidable part 802 is aligned with the opening 901, any action on the rod 810 that holds the slidable part 802 in the second position is stopped so that the slidable part 802 moves from its second position to its first position due the bias of spring 805. When the slidable part 802 is in its first position, the second end 809 of the slidable part 802 is located in the opening 901 and the luminaire support 102 is therefore prevented from moving out of the light pole connector 101. The luminaire support 102 remains connected to the light pole connector 101 until an action on the rod 810 moves the slidable part 802 from its first position to its second position.

The electrical connectors 1001 and 1002 are arranged so that they are connected to each other when the luminaire support 102 is attached to the light pole connector 101 by the slidable part 802.

The pole climbing device may comprise a component for carrying the luminaire support 102 and a separately controllable component for inserting into the luminaire support 102 for moving the slidable part 802 from its first position to its second position. For example, the component for carrying the luminaire support 102 may be part of the arm 302 and the component for moving the slidable part 802 from its first position to its second position may be a connecting part 303 on the arm.

Accordingly, a pole climbing device may carry the luminaire support 102 up a pole 104. If support 102 has a catch 812, a component in the pole climbing device moves the catch to its second position so that the slidable part 802 is not prevented from moving. The pole climbing device moves the luminaire support 102 into the light pole connector 101 so that, when in the light pole connector 101, the slidable part 802 moves from its second position to its first position and thereby attaches the luminaire support 102 to the light pole connector 101. The pole climbing device can then move back down the pole 104 leaving the luminaire support 102 connected to the light pole connector 101.

The processes of the pole climbing device attaching a luminaire support 102 to the light pole connector 101 are similar to the processes for detaching a luminaire support 102 from the light pole connector 101, but performed in substantially the reverse order.

Embodiments include the luminaire support 102 and light pole connector 101 being held together and released by other attachment techniques. For example, the connecting part between the luminaire support 102 and light pole connector 101 may arranged to rotate in response to a linear movement by an arm 302 of the pole climbing device in order for the attachment and detachment to be made.

Light pole connectors 101 according to embodiments can be attached to any design of pole 104. Advantageously, known light pole systems can be retrofitted with the light pole connector 101 and luminaire support 102 according to embodiments so that the luminaires 103 of the light pole system can be both taken down and installed by a pole climbing device.

The easily releasable connection between the light pole connector 101 and luminaire support 102 according to embodiments improves known techniques for attaching a luminaire 103 to a pole 104.

Although it is preferable that a pole climbing device takes down and installs the luminaires 103, this is not essential and embodiments include other techniques for taking down and installing the luminaires 103.

Figure 11D:
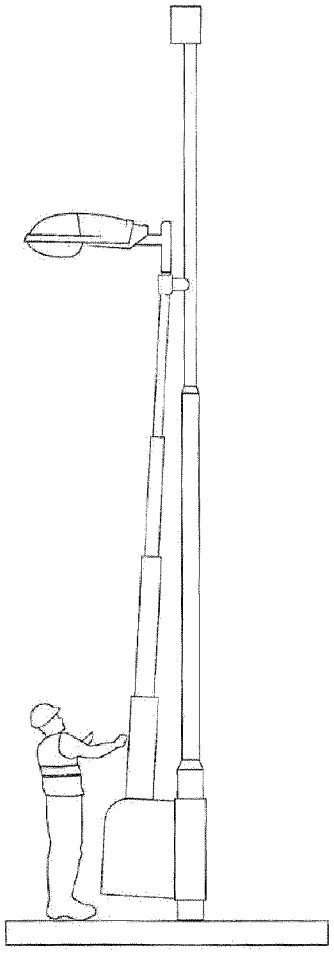
FIGS. 11A, 11B, 11C and 11D show steps in the operation of detaching the luminaire support from the light pole connector according to an embodiment.
Figure 11C:
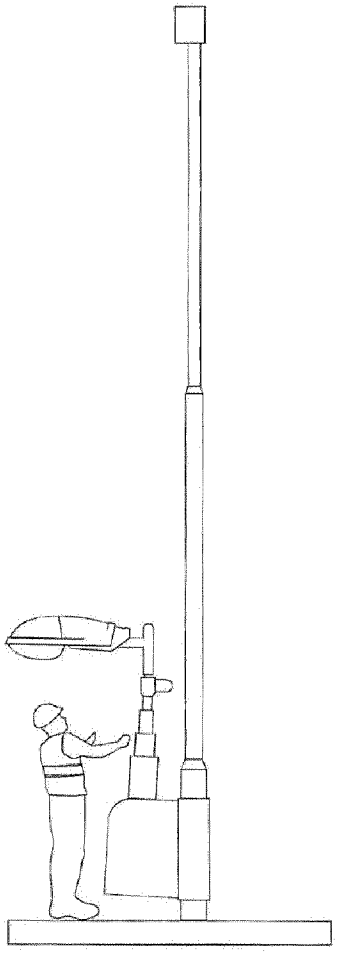
Figure 11B:
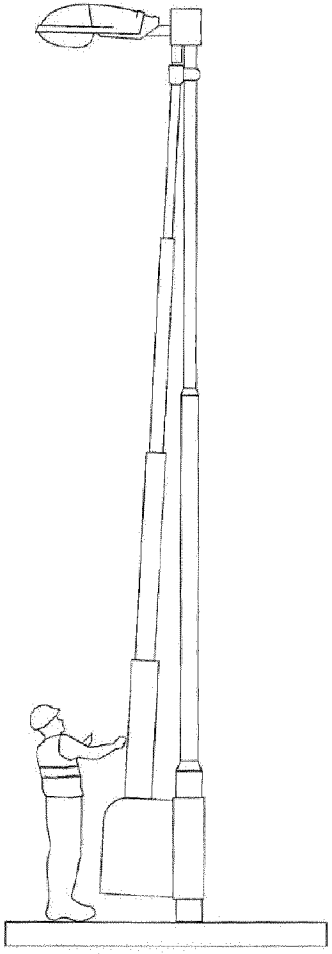
Figure 11A:
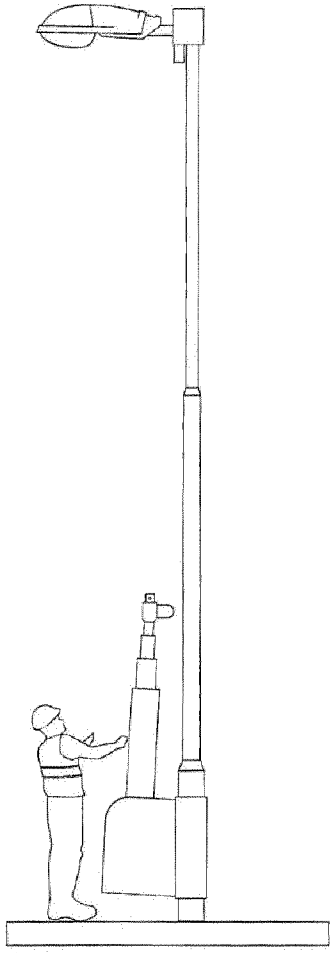

For example, embodiments include the use of a luminaire raising device with a telescopic arm as shown in FIGS. 11A to 11D. The end of the arm of the luminaire raising device may be substantially the same as the arm 302 of the pole climbing device and may comprise an equivalent component to the connecting part 303. The end of the arm of the luminaire raising device can be moved from a retracted position, as shown in FIG. 11A, to an extended position, as shown in FIG. 11B, with the main body of luminaire raising device remaining a ground level. The end of the arm may detach a luminaire support 102 from a light pole connector 101 and lower the luminaire 103 and luminaire support 102 as shown in FIG. 11C. As shown in FIG. 11D, the luminaire raising device may also raise a luminaire 103 and luminaire support 102 and connect the luminaire support 102 to the light pole connector 101. The luminaire raising device may be driven mechanically, electrically and/or hydraulically.

Figure 12C:
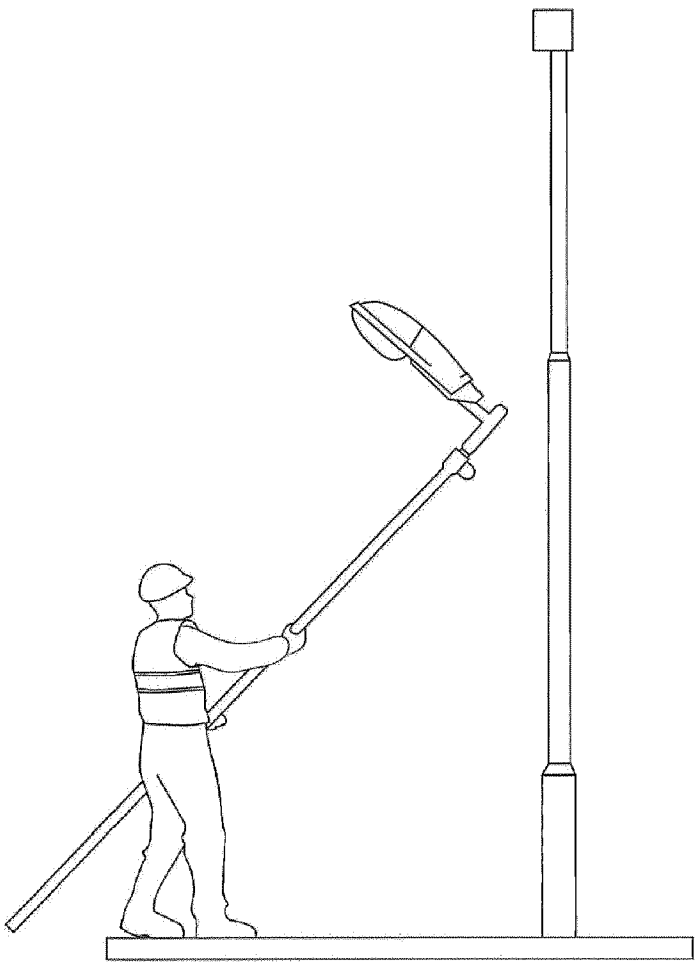
FIGS. 12A, 12B and 12C show steps in the operation of detaching the luminaire support from the light pole connector according to an embodiment.
Figure 12B:
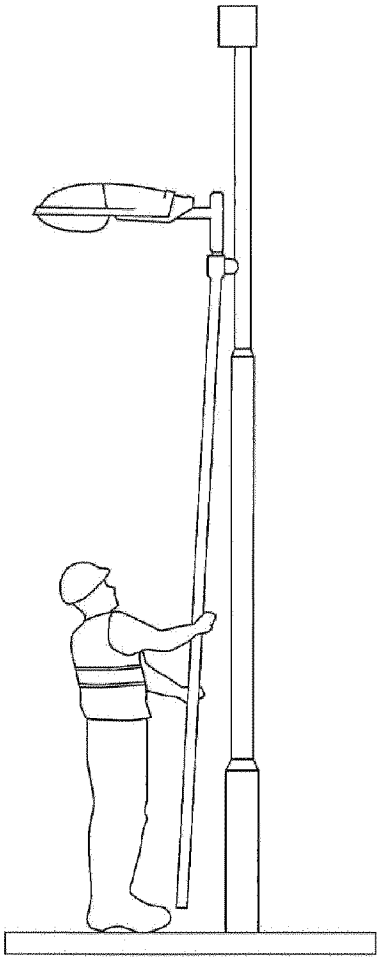
Figure 12A:
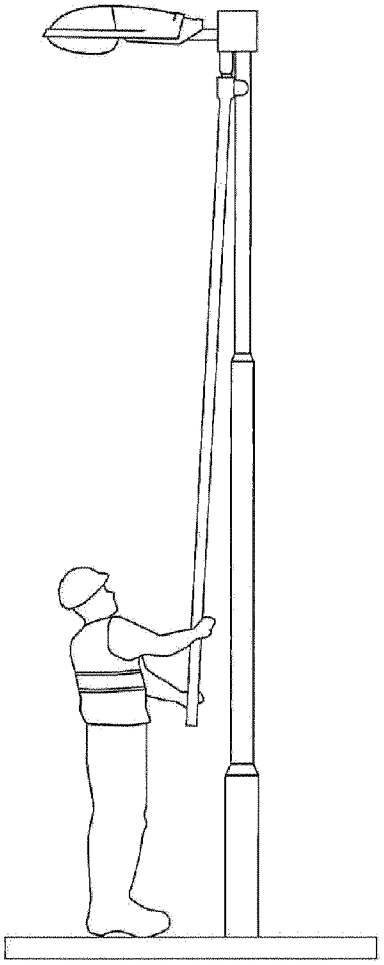

Embodiments also include the use of a luminaire raising device with a fixed length arm as shown in FIGS. 12A to 12C. The fixed length arm may be substantially the same as the telescopic arm, as described with reference to FIG. 11A to 11D, when the telescopic arm is in its extended position. As shown in FIGS. 12A to 12C, the luminaire raising device of the present embodiment may both lower and raise a luminaire 103 and a luminaire support 102, with the luminaire support 102 being attached to, and detached from, a light pole connector 101.

Embodiments also include the luminaires 103 being serviced by a human operator on an raisable elevation platform with an operator manually attaching, and detaching, the luminaire support 102 and the light pole connector 101.

Preferably, the light pole system comprises a processor and a communications device for receiving and/or sending data. The processor may be used to control the luminaire 103 and/or perform diagnostic test on the luminaire 103. For example, the processor may receive, via the communications device, instructions to illuminate the luminaire 103 with a particular power or to switch the luminaire 103 off. The control of the luminaire 103 is therefore improved. The processor may perform a diagnostic test on the luminaire 103 to determine if the luminaire 103 is operating correctly. Any faults with the luminaire 103 can be automatically detected and reported, via the communications device, to an operator's system so that the operator is automatically informed that the luminaire 103 needs servicing.

The processor and communications device may be located in any of the luminaire 103, luminaire support 102, light pole connector 101 and light pole 104. The processor and communications device may be located together or in separate parts of the light pole system. Preferably, the processor and communications device are located in the luminaire support 102 and/or the light pole connector 101. A light pole system without remote control and diagnostic capability can therefore be improved by retrofitting it with the luminaire support 102 and the light pole connector 101.

The pole climbing device may further comprise one or more further wheels that can contact the pole 104 and have an axis of rotation that is parallel to the axis of the pole 104.

Rotation of the further wheel causes the rotation of the pole climbing device around the pole 104. The ability to rotate the pole climbing device around the pole 104 aids the alignment of the pole climbing device arm 302 with the luminaire support 102.

Figure 13A:
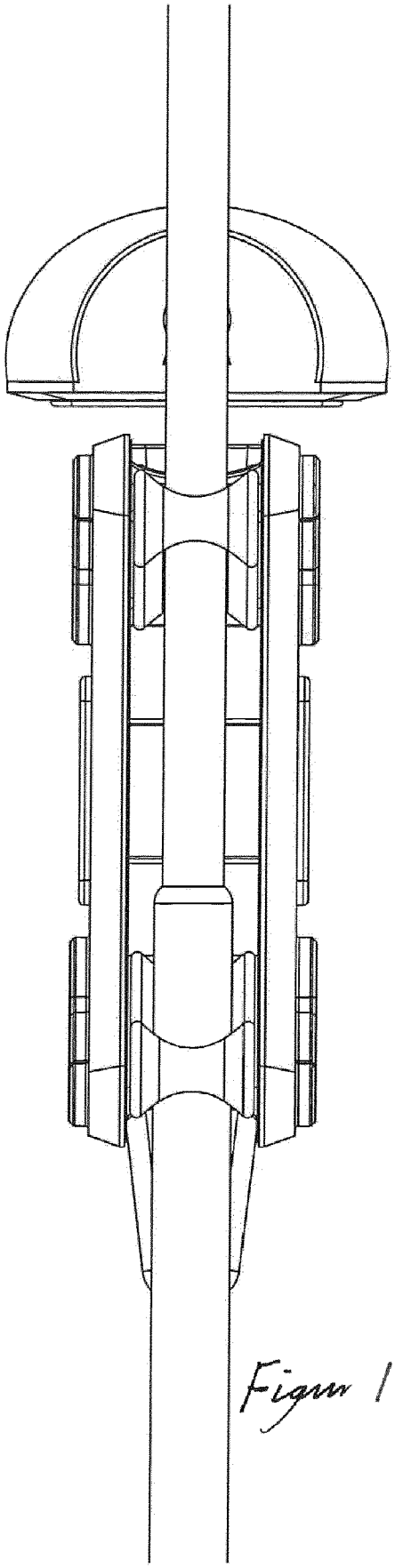
FIGS. 13A and 13B show tiltable wheels according to an embodiment.
Figure 13B:
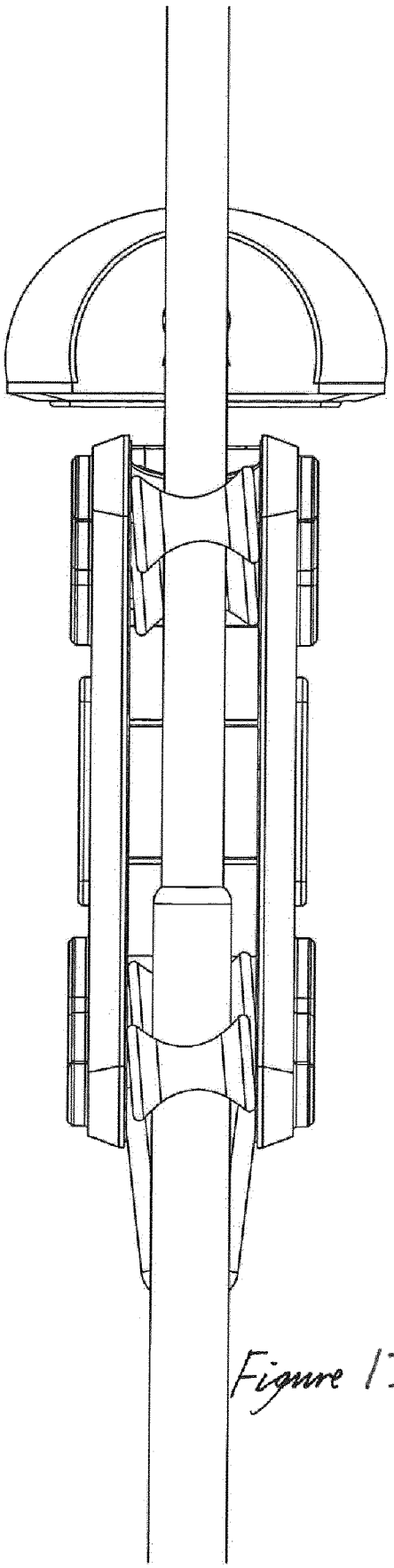

Embodiments also include one or more wheels of the pole climbing device being tiltable so that their axis of rotation is no longer orthogonal to the longitudinal axis of the pole 104. FIG. 13A shows the alignment of the wheels with the axis of rotation of the wheels orthogonal to the longitudinal axis of the pole 104. FIG. 13B shows the alignment of the wheels with the axis of rotation of each of the wheels rotated so that it is not orthogonal to the longitudinal axis of the pole 104. Advantageously, the rotation of the wheel axes as shown in FIG. 13B causes the pole climbing device to rotate around the pole. Accordingly, the pole climbing device can be attached to a pole 104 with the wheels aligned as shown in FIG. 13A. As the pole climbing device approaches the luminaire support the wheels axes can be rotated/tilted so that the pole climbing device rotates around the pole and is aligned with the luminaire support. The wheel axes may then be rotated back to the alignment as shown in FIG. 13A.

Figure 14A:
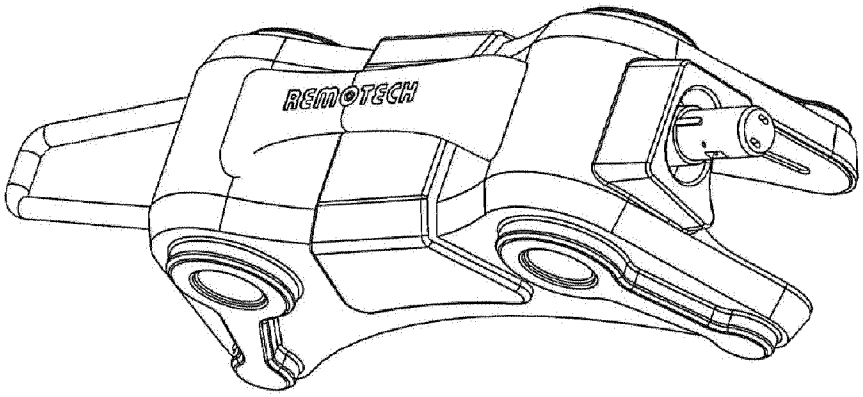
FIGS. 14A, 14B and 14C show the rotation of an arm of the pole climbing device relative to the body of the pole climbing device according to an embodiment.
Figure 14B:
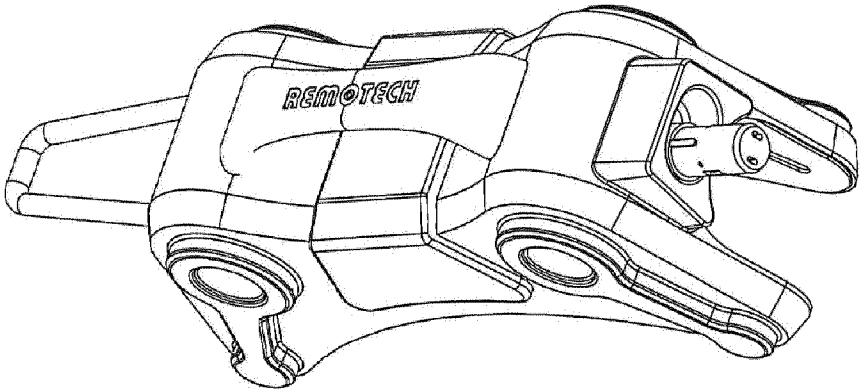
Figure 14C:
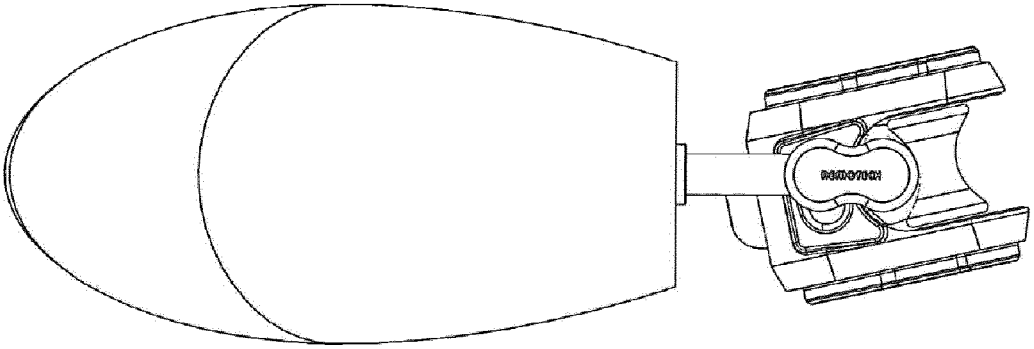

Embodiments also include the arm 302 of the pole climbing device additionally, or alternatively, being arranged to rotate relative to the main body of the pole climbing device. FIG. 14A shows the arm 302 in a central position from which it is able to rotate about the axis of the pole, for example by 10 degrees in either direction of rotation. FIG. 14B shows the arm 302 rotated so that it has moved around the longitudinal axis of the pole 104. The arm 302 can therefore move into a correct alignment position with the luminaire support 102 without the main body of the pole climbing device needing to rotate around the pole 104. As shown in FIG. 14C, the luminaire support 102 and main body of the pole climbing device do not need to be aligned for the arm 302 of the pole climbing device to engage and operate with the luminaire support 102.

Figure 15:
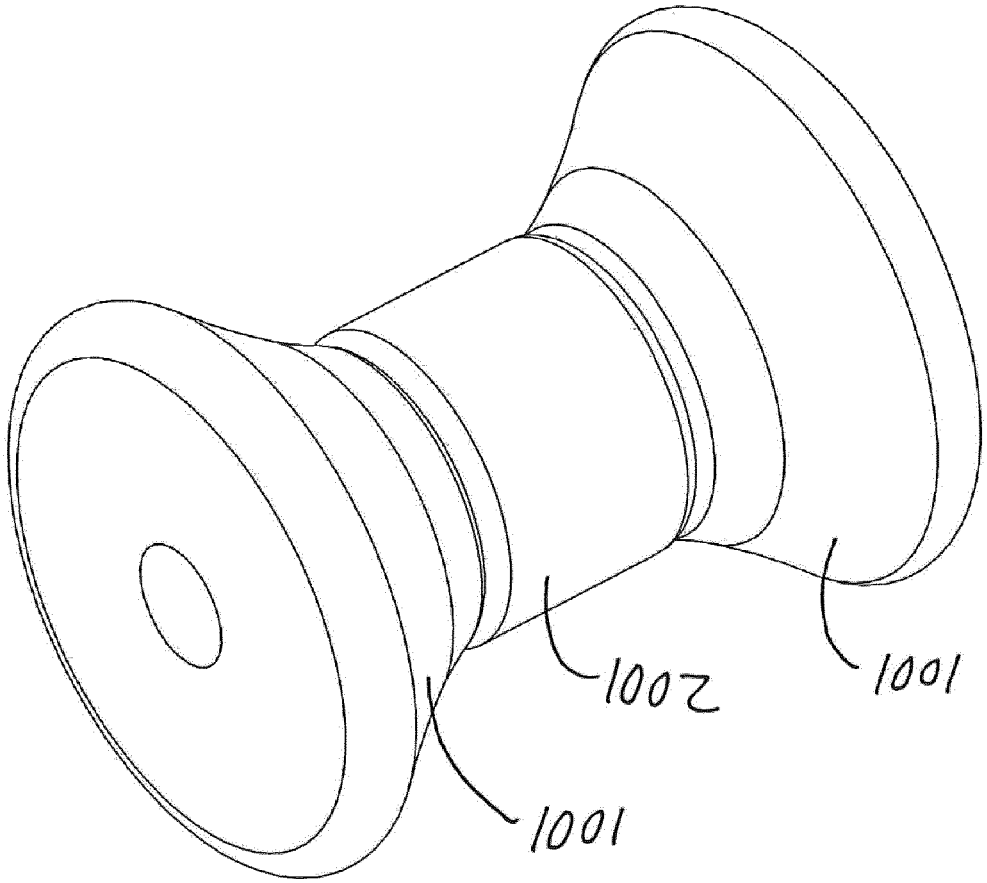
FIG. 15 shows a wheel according to an embodiment.

FIG. 15 shows a design of a wheel of the pole climbing device according to a preferred embodiment. The wheel comprises a central part 1002 and two wings 1001. The central part 1002 is substantially cylindrical. Each of the wings 1001 is substantially conical and the wings are provided on opposite ends of the central part 1002. The central part 1002 and wings 1001 all have a bore and the axis about which the wheel rotates passes through each of the bores. The central part 1002 is preferably made of a material that is firmer/harder/higher density than each of the wings 1001. When the wheel is pressed into a pole 104, the shape of each of the wings 1001 deforms slightly due to the wings being made of a relatively soft material. The harder central part 1002 of the wheel does not deform to the same extent and therefore forms a strong contact with the pole 104 so that the pole climbing device does not slip down the pole 104. The shape of the wheel therefore changes so that it is appropriate for the diameter and shape of the pole 104. This is particularly advantageous when the diameter of the pole 104 that the pole climbing device climbs changes along the length of the pole 104.

In an alternative embodiment, a linear rail may be permanently attached to a pole 104. The pole climbing device may be arranged to attach to, climb and descend the rail. Advantageously, the problem with aligning the pole climbing device and the luminaire support 102 and/or light pole connector 101 is avoided.

Depending on the application, there are a number of possible dimensions of light pole system. For example, a light pole 104 for illuminating a major road or stadium will typically have larger dimensions than a light pole 104 for illuminating a path in a pedestrian only area. The light pole connector 101, luminaire support 102 and pole climbing device according to embodiments can all be made across a range of dimensions as required for use with light pole systems with differing dimensions. Preferably, the pole climbing device can grip and be used on poles 104 with a range of outer diameters, such a 60 mm to 300 mm outer diameter range.

Exemplary dimensions according to embodiments are:

Pole climbing device length (along longitudinal axis of pole)=680 mm; Pole climbing device width (along axis of rotation of wheel(s) that moves the pole climbing device along the pole)=240 mm; Pole climbing device depth (along an orthogonal axis to the longitudinal axis of pole and axis of rotation of wheel(s) that moves the pole climbing device along the pole)=327 mm;

Light pole connector length (along longitudinal axis of pole)=164 mm; and Light pole connector width (along an orthogonal axis to the longitudinal axis of pole and axis of rotation of wheel(s) that moves the pole climbing device along the pole)=150 mm.

Alternatively, light pole connector length (along longitudinal axis of pole)=250 mm, when the pole diameter is 60 mm. The part(s) of the light pole connector that receive the pole and/or the luminaire support are tubular with an outer diameter of 97.8 mm and an inner diameter of 76 mm.

The climbing speed of the pole climbing device may be about 1 $ms^{-1}$.

Preferably, the pole climbing device is capable of carrying a mass of 25 kgs or more up and down a pole 104.

The light pole connector 101 and luminaire support 102 may be constructed with known materials in the industry, such as hot dip galvanised steel.

In the embodiments described above, there are electrical connections between the power supply in the pole 104, the light pole connector 101, the luminaire support 102 and the luminaire 103 components of the light pole system. Embodiments include alternative electrical connections between any of these components from those described above. In particular, the connection between any of the components may alternatively by via an inductive power transfer. For example, one of the halves of a transformer may be provided on each of both sides of the power transfer interface between two components. Advantageously, transferring the power inductively avoids the need for a combined mechanical and electrical connection between components of the light pole system.

The luminaire support 102 and light pole connector 101 may be alternatively be held together by, for example, an electro-magnet so that there is no need for a mechanical connection between them.

It is not essential for the pole climbing device to have an arm 302 for inserting into the luminaire support 102 and embodiments include other interfaces between these components. In particular, the pole climbing device may comprise an integrated tool at the interface with the luminaire support 102 for attaching and detaching the luminaire support 102 and the light pole connector 101.

Embodiments also include the pole climbing device being used to attach and detach other components than luminaires 103 from elevated positions on a pole 104. In particular, embodiments include the light pole connector 101 and luminaire support 102 being provided as described herein but with the luminaire support 102 being attachable to a solar panel, sign, or other elevated object instead of, or in addition to, a luminaire 103.

Other embodiments of the invention will be apparent to those skilled in the art from consideration of the specification and practice of the embodiments disclosed herein. It is intended that the specification and examples be considered as exemplary only, with a true scope and spirit of the invention being indicated by the following claims. In addition, where this application has listed the steps of a method or procedure in a specific order, it may be possible, or even expedient in certain circumstances, to change the order in which some steps are performed, and it is intended that the particular steps of the method or procedure claims set forth herebelow not be construed as being order-specific unless such order specificity is expressly stated in the claim.

The invention claimed is:

1. A pole climbing device for climbing and descending a pole of a light pole system, the pole climbing device comprising:

a gripping mechanism for gripping the pole of the light pole system;

a drive mechanism for moving the pole climbing device along the pole; and a connector for connecting the pole climbing device to a luminaire support.

2. The pole climbing device according to claim 1, further comprising:

a communication device so that the operation of the pole climbing device is controllable remotely;

a moveable part that, in use, is moveable by the pole climbing device to cause attachment or detachment of the luminaire support and a light pole connector, the moveable part is arranged so that movement of at least part of the moveable part along an axis that is parallel and/or orthogonal to a longitudinal axis of the pole causes attachment and/or detachment of the luminaire support and the light pole connector; and wherein the connector for connecting the pole climbing device to the luminaire support is comprised by an arm of the pole climbing device.

3. The pole climbing device according to claim 1, further comprising a bracket arranged at an end of the pole climbing device such that, when the pole climbing device descends the pole which is vertical, the bracket is the first part of the pole climbing device to contact the ground at the base of the pole, and wherein the pole climbing device is arranged so that it is stackable with one or more further pole climbing devices.

4. The pole climbing device according to claim 1, wherein:

the pole climbing device comprises an elongated arm;

in use on the pole, a longitudinal axis of the arm of the pole climbing device is parallel to a longitudinal axis of the pole;

the gripping mechanism for gripping the pole of the light pole system is adaptable to grip the pole having a diameter of up to 1000 mm; and the pole climbing device further comprises a mechanism for moving the arm of the pole climbing device around the longitudinal axis of the pole when the gripping mechanism is gripping the pole, with the connector moving relative to a main body of the pole climbing device.

5. The pole climbing device according to claim 1, wherein the pole climbing device further comprises one or more wheels for moving the pole climbing device along the pole, and wherein at least one wheel of the one or more wheels is arranged to tilt such that, in use, tilting the at least one wheel of the one or more wheels rotates the pole climbing device around the pole, the at least one wheel of the one or more wheels include:

a central part and first and second wings;

the first and second wings are attached to opposite ends of the central part; and when the at least one wheel is pressed against the pole, the first and second wings deform the central part of the wheel.

6. A method of attaching a luminaire to a pole of a light pole system, wherein the light pole system comprises the pole and a light pole connector attached to the pole, the method comprising:

connecting a pole climbing device to the pole;

connecting a luminaire support to the pole climbing device, wherein the luminaire is attached to the luminaire support;

operating the pole climbing device so that it moves along the pole and connects the luminaire support to the light pole connector;

operating the pole climbing device so that it attaches the luminaire support to the light pole connector;

wherein the light pole connector comprises:

a first attachment part for attaching the light pole connector to the pole of the light pole system; and a second attachment part for attaching the luminaire support to the light pole connector, wherein the first attachment part is arranged to receive electrical power from the pole, the second attachment part comprises a connector for providing the electrical power received by the first attachment part to the luminaire support; and the attachment between the light pole connector and the luminaire support is a releasable attachment;

wherein luminaire support comprises:

a first attachment part for attaching the luminaire support to the light pole connector of the light pole system; and a second attachment part for attaching the luminaire support to the luminaire of the light pole system, wherein the first attachment part comprises an electrical connector to a power supply in the light pole connector; and the attachment between the luminaire support and the light pole connector is a releasable attachment; and wherein the pole climbing device comprises:

a gripping mechanism for gripping the pole of the light pole system; and a drive mechanism for moving the pole climbing device along the pole; and a connector for connecting the pole climbing device to the luminaire support.

* * * * *